US009061504B2

(12) United States Patent
Mizutani et al.

(10) Patent No.: US 9,061,504 B2
(45) Date of Patent: Jun. 23, 2015

(54) LIQUID JETTING APPARATUS

(71) Applicants: Hiromitsu Mizutani, Ichinomiya (JP); Yusuke Suzuki, Anjo (JP); Taisuke Mizuno, Nagoya (JP); Shohei Koide, Nagoya (JP); Atsushi Ito, Nagoya (JP); Keita Hirai, Nagoya (JP)

(72) Inventors: Hiromitsu Mizutani, Ichinomiya (JP); Yusuke Suzuki, Anjo (JP); Taisuke Mizuno, Nagoya (JP); Shohei Koide, Nagoya (JP); Atsushi Ito, Nagoya (JP); Keita Hirai, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 11 days.

(21) Appl. No.: 14/215,265

(22) Filed: Mar. 17, 2014

(65) Prior Publication Data

US 2014/0292869 A1 Oct. 2, 2014

(30) Foreign Application Priority Data

Mar. 27, 2013 (JP) ..... 2013-065636

(51) Int. Cl.
*B41J 2/07* (2006.01)
*B41J 2/165* (2006.01)

(52) U.S. Cl.
CPC ..... *B41J 2/16585* (2013.01); *B41J 2/16526* (2013.01); *B41J 2002/16529* (2013.01)

(58) Field of Classification Search
CPC ..... B41J 2/16517; B41J 2002/16502; B41J 2002/16573; B41J 2/04563; B41J 2/165; B41J 11/0085; B41J 2/07; B41J 2/14
USPC ..... 347/9, 14, 35, 60
See application file for complete search history.

(56) References Cited

U.S. PATENT DOCUMENTS

| | | | | |
|---|---|---|---|---|
| 7,014,292 | B2 * | 3/2006 | Yazawa et al. | 347/29 |
| 8,356,880 | B2 * | 1/2013 | Hirosawa et al. | 347/30 |
| 2004/0150692 | A1 | 8/2004 | Hara | |
| 2007/0134969 | A1 | 6/2007 | Endo et al. | |
| 2008/0192083 | A1 | 8/2008 | Nishida | |
| 2008/0218554 | A1 | 9/2008 | Inoue | |
| 2010/0238230 | A1 | 9/2010 | Endo et al. | |
| 2012/0081427 | A1 | 4/2012 | Nishida | |

FOREIGN PATENT DOCUMENTS

| | | |
|---|---|---|
| JP | 2004-237557 | 8/2004 |
| JP | 2005-262523 | 9/2005 |
| JP | 2007-176152 | 7/2007 |
| JP | 10-258531 | 9/2008 |
| JP | 2008/221534 | 9/2008 |
| JP | 2008-221836 | 9/2008 |
| JP | 2008-260172 | 10/2008 |
| JP | 2012-076253 | 4/2012 |

* cited by examiner

*Primary Examiner* — Thinh Nguyen
(74) *Attorney, Agent, or Firm* — Frommer Lawrence & Haug LLP

(57) ABSTRACT

There is provided a liquid jetting apparatus including: a liquid jetting head including a pressure generating element and a plurality of nozzles arranged in rows in a nozzle-row direction; and a controller. The controller is configured to: determine a basic flushing amount for each nozzle; make the liquid jetting head carry out flushing with the basic flushing amount for inner-side nozzles positioned at an inner side in the nozzle-row direction; and make the liquid jetting head carry out flushing with a flushing amount larger than the basic flushing amount, for outer-side nozzles positioned at an outer side in the nozzle-row direction, of the inner-side nozzles.

11 Claims, 14 Drawing Sheets

LIQUID JETTING APPARATUS

CROSS REFERENCE TO RELATED APPLICATION

The present application claims priority from Japanese Patent Application No. 2013-065636, filed on Mar. 27, 2013, the disclosure of which is incorporated herein by reference in its entirety.

BACKGROUND OF THE INVENTION

1. Field of the Invention

The present invention relates to a liquid jetting apparatus.

2. Description of the Related Art

In a liquid jetting apparatus including a head which jets a liquid, if a time period during which the liquid is not jetted from a plurality of nozzles of the liquid jetting head becomes long, a viscosity of the liquid inside the nozzle increases due to drying. This phenomenon of increase in the viscosity will also be called as 'thickening' in the following description. As the liquid is thickened, jetting of the liquid from the nozzle cannot be carried out normally, and there is a possibility of occurrence of a jetting defect such as non-jetting. Therefore, sometimes, a jetting operation is carried out preliminarily from each of the plurality of nozzles prior to the basic jetting operation. In such manner, the thickened liquid inside the nozzle is discharged beforehand. This liquid discharge operation is also called as 'flushing'.

A printer including an ink-jet head which jets an ink has hitherto been known. When the ink-jet head is not carrying out recording of an image etc. on a recording paper, the plurality of nozzles in the ink-jet head is covered by a cap member. When the ink-jet head carries out the recording operation on the recording paper, the cap member is removed from the ink-jet head. Thereafter, flushing of the ink-jet head is carried out immediately before the recording operation.

SUMMARY OF THE INVENTION

An environmental condition around the nozzle, particularly a humidity condition, differs for nozzles positioned at an inner side (inner-side nozzles) and nozzles positioned at an outer side (outer-side nozzles), of the plurality of nozzles of the liquid jetting head. Therefore, a liquid in the outer-side nozzles is more susceptible to drying than a liquid in the inner-side nozzles, and thickening of the liquid is susceptible to be faster in the outer-side nozzles.

In other words, since the inner-side nozzles are surrounded by other nozzles jetting the liquid, the humidity of the environment in the vicinity of the inner-side nozzles is susceptible to become high. Whereas, the number of other nozzles in the vicinity of the outer-side nozzles is smaller than the number of nozzles in the vicinity of the inner-side nozzles. Therefore, the humidity of the environment in the vicinity of the outer-side nozzles is susceptible to become low. Furthermore, the humidity is lowered also due to an effect of an air flow near the liquid jetting head. Therefore, the drying of liquid in the outer-side nozzles is susceptible to be even faster.

An object of the present invention is to discharge assuredly by flushing the thickened liquid in the outer-side nozzles in which the liquid is susceptible to thickening.

According to an aspect of the present invention, there is provided a liquid jetting apparatus configured to jet a liquid onto a medium, including:

a liquid jetting head including a plurality of nozzles arranged in rows in a nozzle-row direction, and a pressure generating element configured to generate pressure for jetting the liquid from the plurality of nozzles toward the medium; and a controller configured to:

determine a basic flushing amount for each nozzle;

make the liquid jetting head carry out flushing with the basic flushing amount for inner-side nozzles positioned at an inner side in the nozzle-row direction; and make the liquid jetting head carry out flushing with a flushing amount larger than the basic flushing amount, for outer-side nozzles positioned at an outer side in the nozzle-row direction, of the inner-side nozzles.

In the present invention, the 'flushing amount' is the amount of liquid that is jetted from each nozzle at the time of flushing. A controller, firstly, determines the basic flushing amount for each nozzle. Moreover, the controller performs the flushing with the basic flushing amount for the inner-side nozzles that are positioned at the inner side in the nozzle-row direction which is a direction of arrangement in rows. On the other hand, the controller performs flushing with a flushing amount larger than the basic flushing amount, for the outer-side nozzles which are positioned at the outer side in the nozzle-row direction than the inner-side nozzles. Accordingly, it is possible to discharge assuredly the thickened liquid from the outer-side nozzles in which the thickening of liquid is susceptible to be faster than the thickening in the inner-side nozzles. Moreover, the flushing amount is not increased for all the nozzles, but the flushing amount is made more than the basic flushing amount only for the outer-side nozzles. Accordingly, the liquid is prevented from being discharged in a large amount unnecessarily from the inner-side nozzles, and it is possible to suppress an amount of waste liquid due to flushing, to be small. In the present specification, the term 'an operation status' means not only a status of the liquid jetting apparatus but also an environmental condition such as a humidity condition or a temperature condition in the liquid jetting apparatus.

In the present invention, the flushing is carried out with the basic flushing amount for the outer-side nozzles. Moreover, the flushing is carried out with the flushing amount larger than the basic flushing amount, for the outer-side nozzles which are positioned at the outer side of the inner-side nozzles. Accordingly, it is possible to discharge the thickened liquid assuredly from the outer-side nozzles in which the thickening of liquid is susceptible to be faster as compared to the thickening in the inner-side nozzles. Moreover, the flushing amount of the outer-side nozzles is set to be larger than the basic flushing amount. Accordingly, it is possible to prevent the liquid from being discharged in large amount unnecessarily from the inner-side nozzles, and to suppress the amount of waste liquid due to flushing, to be small. Moreover, the flushing amount for the outer-side nozzles being large, an amount of heat transferred to the liquid that flows at an outer-side portion of the liquid jetting head becomes larger as compared to an amount of heat transferred to the liquid at an inner-side portion of the liquid jetting head. Accordingly, it is possible to suppress a difference in temperature of liquids between the outer-side portion and the inner-side portion of the liquid jetting head, for which an amount of heat released differs.

DETAILED DESCRIPTION OF THE PREFERRED EMBODIMENTS

Next, an embodiment of the present teaching will be described below. The embodiment is an example in which the present teaching is applied to an ink-jet printer which prints an image etc. on a recording paper by jetting inks from nozzles toward the recording paper.

Figure 1:
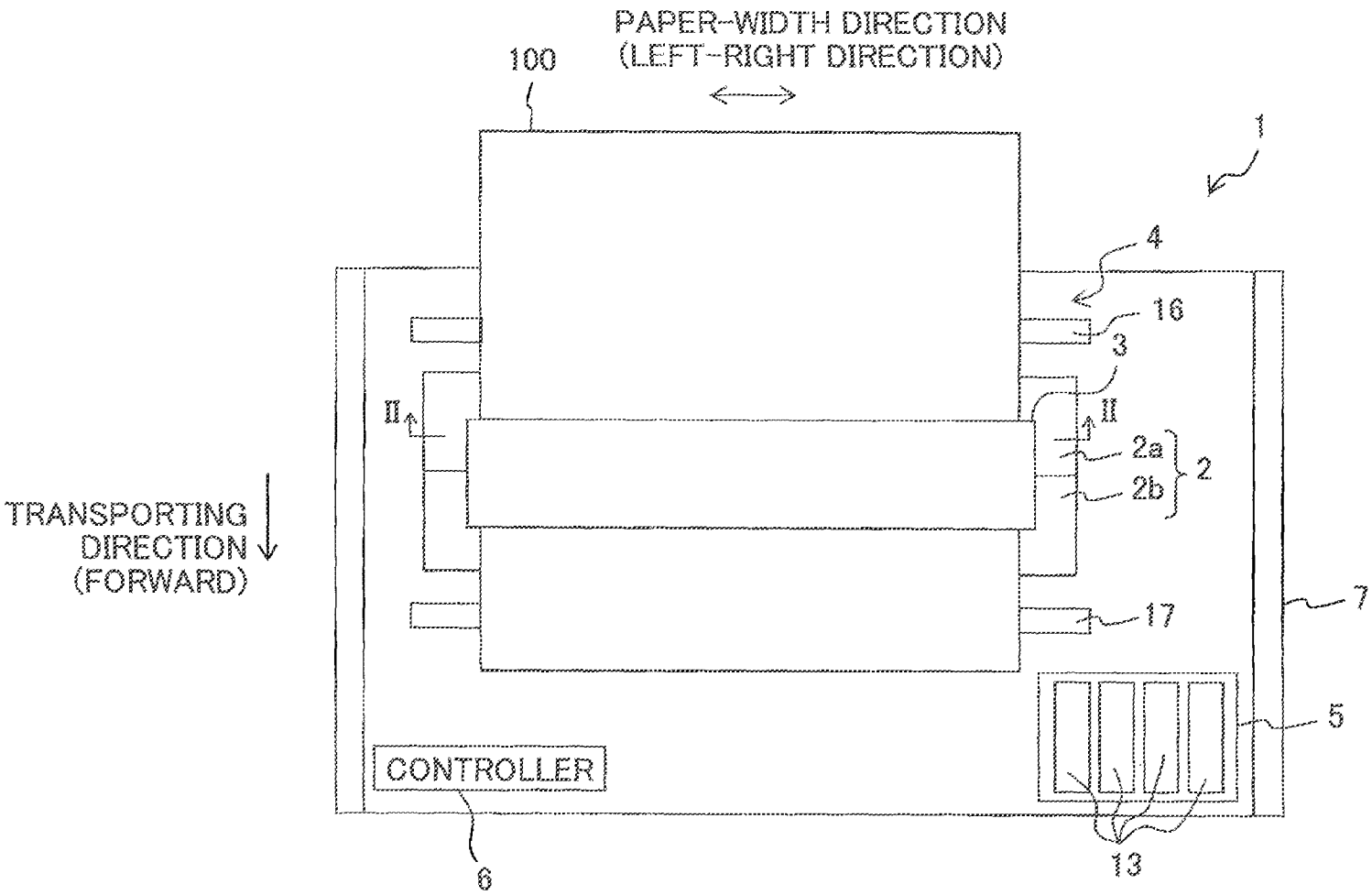
FIG. 1 is a schematic plan view of a printer according to an embodiment of the present invention.

As shown in FIG. 1, the printer 1 includes a platen 2, an ink-jet head 3, a transporting mechanism 4, a cartridge holder 5, and a controller 6 accommodated in a casing 7. A vertical direction in FIG. 1 will be defined as a front-rear direction of the printer 1, a left-right direction in FIG. 1 will be defined as a left-right direction of the printer 1, and a direction perpendicular to a plane-of-paper of FIG. 1 will be defined as a vertical direction of the printer 1. A direction directed from the reverse side toward the front side of the paper is the upward direction.

Figure 2:
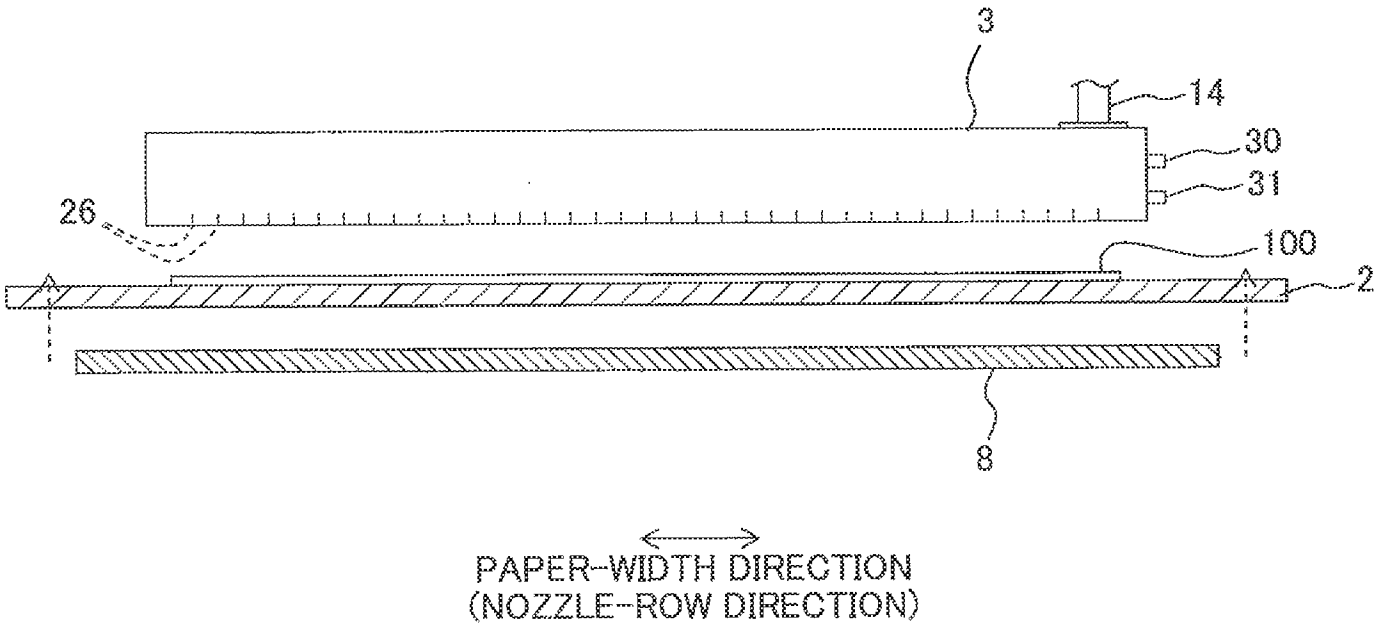
FIG. 2 is a cross-sectional view taken along a line II-II in FIG. 1.

The platen 2 includes two plate members 2*a* and 2*b* arranged side-by-side in the front-rear direction. The two plate members 2*a* and 2*b* may assume a horizontal posture, and an opened posture in which the two plate members 2*a* and 2*b* are opened downward like a double-leaf door. As shown in FIG. 1 and FIG. 2, when the two plate members 2*a* and 2*b* are in the horizontal posture, a recording paper 100 is placed on an upper surface of the two plate members 2*a* and 2*b*.

As shown in FIG. 2, an ink receiving member 8 is arranged under the platen 2. The ink receiving member 8 is a member for receiving the ink jetted at the time of flushing of the ink-jet head 3. As the two plate members 2*a* and 2*b* of the platen 2 are pivoted to be opened as a double door, the ink receiving member 8 positioned under the platen 2 is exposed. As shown by arrows in FIG. 2, at the time of flushing, the ink receiving member 8 is driven up to a position, that is located at an upper side of the platen 2 and is close to a lower surface of the ink-jet head 3, by an ascending and descending mechanism not shown in the diagram. The ink receiving member 8 is a member in the form of a plate formed of glass, for example.

Waste ink jetted from the ink-jet head 3 at the time of flushing is adhered to the ink receiving member 8. A wiper which moves relative to the ink receiving member 8 and wipes the waste ink off may be provided. Moreover, a frame member which surrounds a plurality of nozzles 26 and which is ascendable and descendible with respect to the ink-jet head 3 may be provided at a lower portion of the ink-jet head 3, and the plurality of nozzles 26 may be capped by the frame portion and the ink receiving member 8.

Moreover, at the time of printing continuously on the plurality of recording papers 100 by the ink-jet head 3, sometimes, the flushing of the ink-jet head 3 is carried out while the recording papers 100 are transported. This is also called as flushing in between papers. If the ink receiving member 8 is exposed by opening the platen 2, and furthermore the wiping of the waste ink by the wiper is carried out every time the flushing in between papers is carried out, printing speed is lowered. Therefore, a foam which recovers the waste ink jetted at the time of flushing may be provided in an area of the platen 2, facing the ink-jet head 3. In this case, it is possible to omit various operations related to flushing namely, opening and closing of the platen 2, movement of the ink receiving member 8, and wiping, and it is possible to suppress the lowering of printing speed.

The ink-jet head 3 is arranged at the upper side of the platen 2, with a gap from the platen 2 and the ink-jet head 3. As shown in FIG. 2, the ink-jet head 3 is a so-called line type ink-jet head, and has the plurality of nozzles 26 arranged in rows along a direction of width of the recording paper 100 that is transported. In the embodiment, a transporting direction in which the recording paper 100 is transported and a direction of arrangement in row of the nozzles 26 are orthogonal. However, the transporting direction and the direction of arrangement in row of the nozzles 26 may intersect at an angle other than 90 degrees. In the following description, the direction of arrangement in row of the nozzles 26 which is parallel to the direction of width of paper is also called as a nozzle-row direction.

As shown in FIG. 2, the ink-jet head 3 is provided with a temperature sensor 30 which detects an environmental temperature around the ink-jet head 3, and a humidity sensor 31 which detects an environmental humidity around the ink-jet head 3.

Four ink cartridges 13, which store inks of four colors (black, yellow, cyan, and magenta), are removably installed on the cartridge holder 5. The ink-jet head 3 is connected to the four ink cartridges 13 of the cartridge holder 5 by tubes 14. Accordingly, the inks of four colors are supplied from the four ink cartridges 13 to the ink-jet head 3. The inks are jetted from the plurality of nozzles 26 of the ink-jet head 3 toward the recording paper 100 placed on the platen 2.

The transporting mechanism 4 includes a discharge roller 17 and a feed roller 16 arranged to sandwich the ink-jet head 3 in the front-rear direction. Each of the feed roller 16 and the discharge roller 17 is driven and rotated by a transporting motor 32 (refer to FIG. 3). The transporting mechanism 4 transports the recording paper 100 that is fed by a paper feeding mechanism not shown in the diagram, frontward with respect to the ink-jet head 3 by the feed roller 16 and the discharge roller 17.

Figure 3:
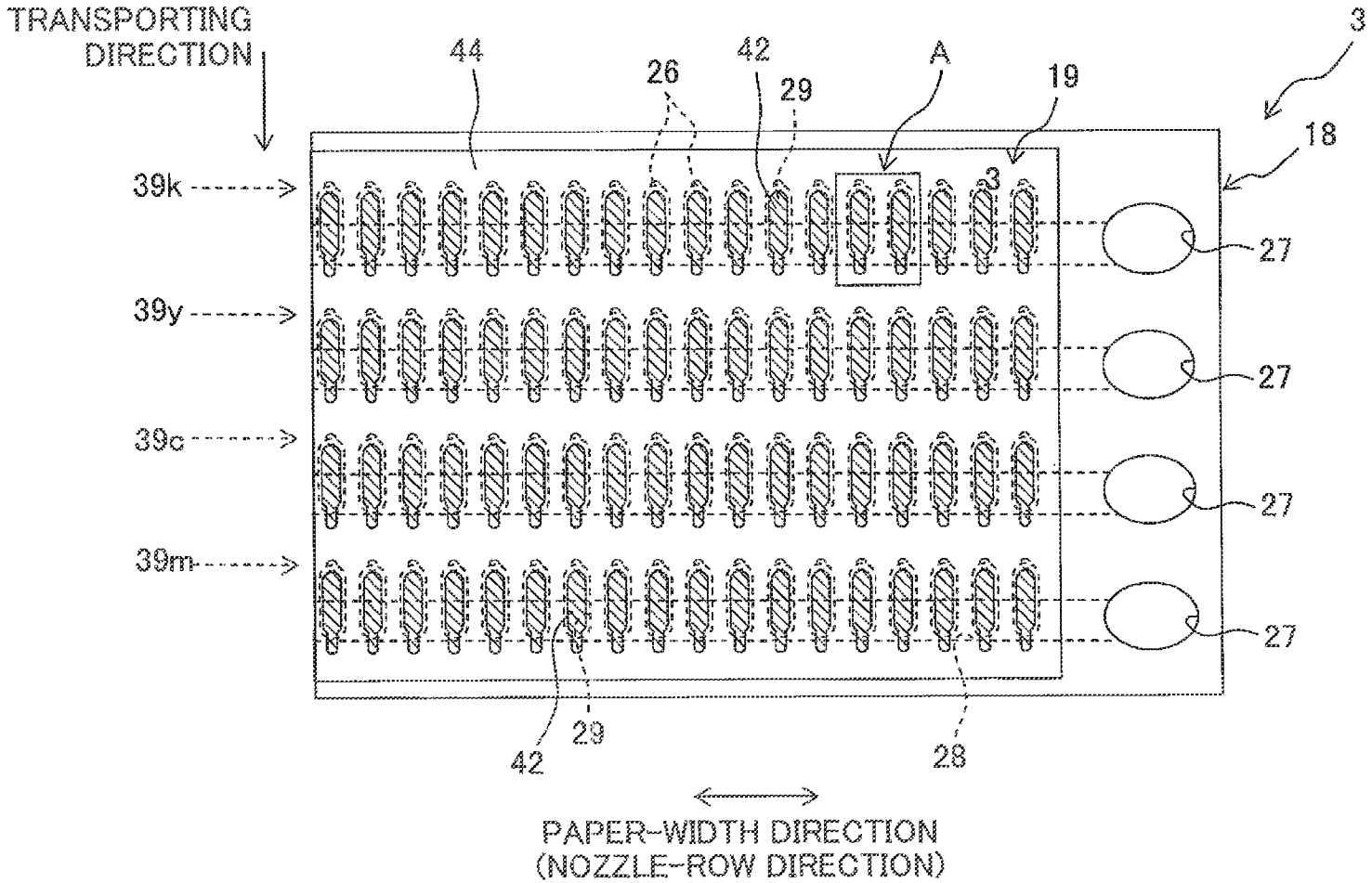
FIG. 3 is a partial plan view of an ink-jet head.
Figure 4A:
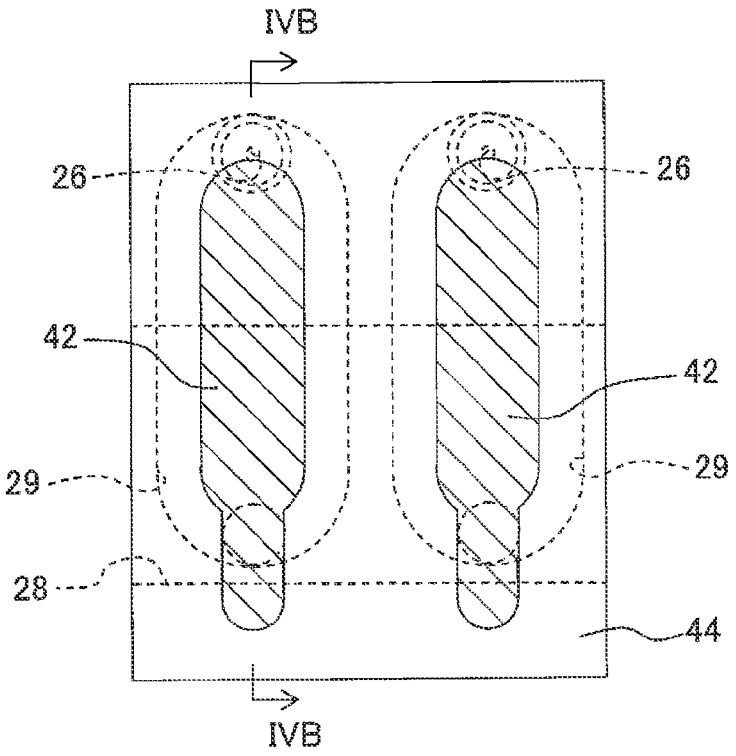
FIG. 4A is an enlarged view of a portion A in FIG. 3.
Figure 4B:
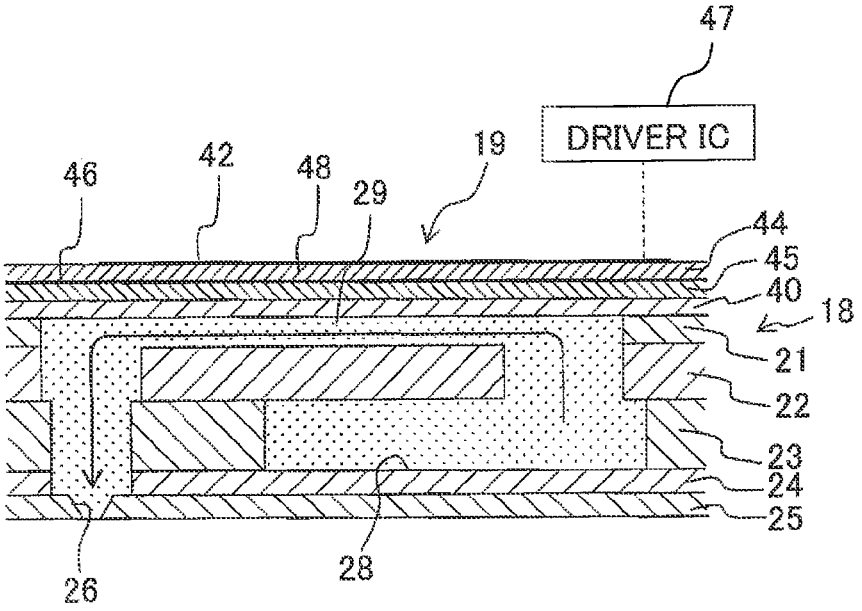
FIG. 4B is a cross-sectional view taken along a line B-B in FIG. 4A.

Next, a concrete arrangement of the ink-jet head 3 will be described below. As shown in FIG. 3 and FIG. 4A and FIG. 4B, the ink-jet head 3 includes a channel unit 18 and a piezoelectric actuator 19.

As shown in FIG. 4B, the channel unit 18 has a structure in which five plates 21 to 25 are stacked. The plate 25 at the lowermost layer is a nozzle plate in which the plurality of nozzles 26 is formed. On the other hand, channels such as manifolds 28 and pressure chambers 29 communicating with the plurality of nozzles 26 are formed in the remaining four plates 21 to 24 on the upper side.

As shown in FIG. 3, four ink supply holes 27 are formed in an upper surface of the channel unit 18. The inks of four colors stored in the four ink cartridges 13 in FIG. 1 are supplied to the four ink supply holes 27 via a head main body. Moreover, at an interior of the channel unit 18, four manifolds 28, each extended in the direction of width of paper, are formed. The four manifolds are connected to the four ink supply holes 27.

Furthermore, the channel unit 18 includes the plurality of nozzles 26, and the plurality of pressure chambers 29 communicating with the plurality of nozzles 26 respectively. As shown in FIG. 3, the plurality of nozzles 26 is arranged in rows in the direction of width of paper, and four nozzle rows 39 corresponding to four manifolds 28 respectively are formed. In FIG. 3, symbols k (black), y (yellow), c (cyan), and magenta (m) indicating the type of ink jetted are suffixed to the four nozzle rows 39. For instance, the nozzle row 39*k* indicates that it is a nozzle row 39 for jetting black ink.

The plurality of pressure chambers 29 is also arranged in rows in the direction of width of paper, similarly as the plurality of nozzles 26, and four pressure chamber rows corresponding to four manifolds 28 respectively are formed. As shown by an arrow mark in FIG. 4B, a plurality of individual channels branched from each manifold 28 and extending toward the nozzle 26 via the pressure chamber 29 is formed inside the channel unit 18.

As shown in FIG. 3, FIG. 4A, and FIG. 4B, the piezoelectric actuator 19 includes a vibration plate 40, piezoelectric layers 44 and 45, a plurality of individual electrodes 42, and a common electrode 46. The vibration plate 40 is joined to the upper surface of the channel unit 18 in a state of covering the plurality of pressure chambers 29. The two piezoelectric layers 44 and 45 are stacked on art upper surface of the vibration plate 40. The plurality of individual electrodes 42 is arranged on an upper surface of the upper piezoelectric layer 44, no that the individual electrodes 42 face the plurality of pressure chambers 29 respectively. The common electrode 46 is arranged between the two piezoelectric layers 44 and 45, to be spread over the plurality of pressure chambers 29.

A portion of the upper piezoelectric layer 44 sandwiched between the individual electrode 42 and the common electrode 46 is called as a piezoelectric element 48, and is polarized in a direction of thickness of the piezoelectric layer 44. The piezoelectric element 48 contracts when there is an electric potential difference between the individual electrode 42 and the common electrode 46, and causes a bending deformation of the vibration plate 40. In other words, in the piezoelectric actuator 19 of the embodiment, the plurality of piezoelectric elements 48 corresponding to the plurality of pressure chambers 29 respectively is connected integrally.

A COF (Chip On Film) which is not shown in the diagram is connected to the plurality of individual electrodes 42. A driver IC 47 is connected to the COF. The driver IC 47 receives a signal from the controller 6 of the printer 1, and supplies a drive signal to each of the plurality of individual electrodes 42.

As the drive signal is supplied from the driver IC 47 to a certain individual electrode 42, a piezoelectric distortion occurs in the piezoelectric element 48 sandwiched between the individual electrode 42 and the common electrode 46, and the vibration plate 40 is deformed to be bent toward the pressure chamber 29. At this time, a volume of the pressure chamber 29 is changed to be decreased. Accordingly, a pressure is applied to the ink inside the individual channel, and the ink is jetted from the nozzle 26.

Next, an electrical configuration of a printer 1 with the controller 6 as a center thereof will be described below. The controller 6 shown in FIG. 2 includes a CPU (Central Processing Unit) 34, a ROM (Read Only Memory) 35, a RAM (Random Access Memory) 36, and an ASIC (Application Specific Integrated Circuit) 37, which are mutually connected by a bus. Moreover, the ink-jet head 3, the transporting motor 32 which drives the feed roller 16 and the discharge roller 17, and an operation panel 33 are connected to the controller 6. Moreover, signals from various sensors such as the temperature sensor 30 and the humidity sensor 31 are input to the controller 6. Furthermore, a PC (Personal Computer) 38 which is an external device is connected to the controller 6.

The controller 6 controls the driver IC 47 of the ink-jet head 3, and driving components of the printer 1 such as the transporting motor 32 by the CPU 34 and the ASIC 37, according to various computer programs stored in the ROM 35. The controller 6 may include a plurality of CPUs, and the processing may be shared by the plurality of CPUs. Moreover, the controller 6 may include a plurality of ASICs, and the processing may be shared by the plurality of ASICs.

As data of an image to be recorded is input from the PC 35, the controller 6 controls the ink-jet head 3 and the transporting motor 32 based on the image data that has been input. The inks are jetted from the plurality of nozzles 26 of the ink-jet head 3 on to the recording paper 100 transported by the feed roller 16 and the discharge roller 17. Accordingly, a desired image is recorded on the recording paper 100.

Moreover, the controller 6 makes jet a predetermined amount of ink from each of the plurality of nozzles 26 of the ink-jet head 3, immediately before an operation of recording on the recording paper 100, or during the operation of recording on the recording paper 100. In such manner, the thickened ink inside the nozzles 26 is discharged. An ink discharge operation of the ink-jet head 3 is called as 'flushing'. Moreover, an amount of ink discharged from each nozzle 26 at the time of flushing is called as 'flushing amount'.

The flushing is to be carried out in the following situations for example. Before recording on the recording paper 100, or during transporting of the plurality of recording papers 100, the controller 6 makes jet the inks from the plurality of nozzles 26 of the ink-jet head 3 toward the ink receiving member 8, in a state of no recording paper 100 placed on the platen 2. Moreover, it is possible to carry out flushing even while the recording paper 100 is transported on the platen 2. In the flushing in this case, small ink droplets which are not noticeable even when landed on the recording paper 100 are made to be jetted from the nozzles 26.

Figure 6:
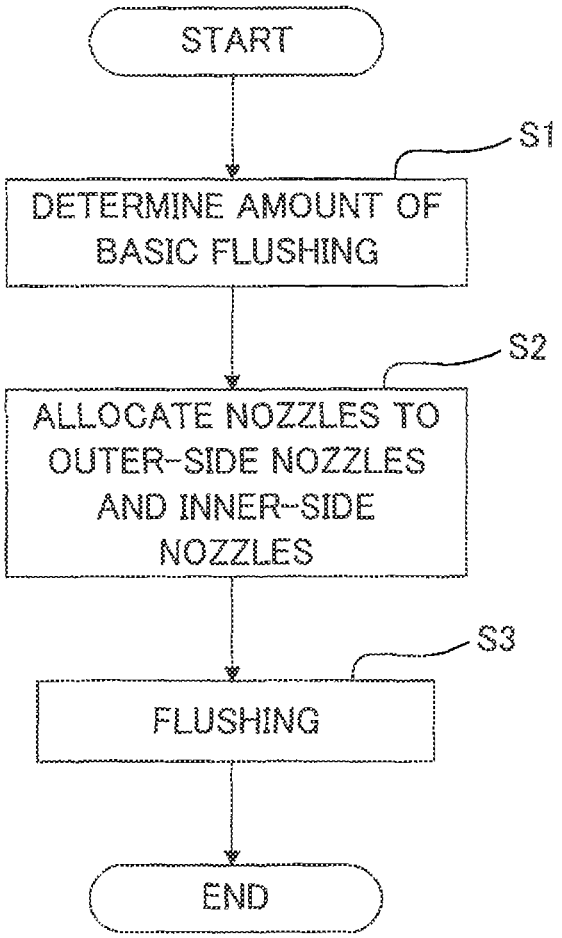
FIG. 6 is a flowchart of a series of controls related to flushing.

Processing carried out by the controller 6 at the time of flushing of the ink-jet head 3 will be described below in detail. FIG. 6 is a flowchart of a series of controls related to flushing. Si (where, i=1, 2, 3, . . . ) indicates the number of each step.

<Determining Basic Flushing Amount>

Firstly, the controller 6 determines a basic flushing amount for each of the plurality of nozzles 6 of the ink-jet head 3 (step S1). It is possible to make the basic flushing amount same for all the nozzles 26 uniformly. However, in the embodiment, the basic flushing amount is set separately for each nozzle 26. For the nozzle 26 with a low frequency of usage in the recording operation prior and after the flushing, a period of not jetting the ink is longer as compared to that for the nozzle 26 with a high frequency of usage. Therefore, thickening of ink is considered to be faster in the nozzle 26 with a low frequency of usage. Therefore, the controller 6 determines the basic flushing amount for each nozzle 26 according to the frequency of usage of the nozzle 26 at the time of recording operation prior to and after the flushing. For instance, the controller 6 determines the basic flushing amount for the nozzle 26 with the low frequency of usage in the recording operation to a value higher (larger) than the basic flushing amount for the nozzle 26 with the high frequency of usage. The controller 6 stores the basic flushing amount determined for each of the nozzles 26 in the RAM.

The basic flushing amount to be determined in this case may be information of the total amount of ink to be jetted from one nozzle 26 at the time of flushing. Or, the basic flushing amount may include information of a jetting frequency (the number of flushings) and a size of liquid droplets to be jetted at a time from one nozzle 26. For example, if the size of liquid droplets to be jetted at a time from one nozzle 26 is 8 pl (picoliters), and the number of flushings is 100, the flushing amount for one nozzle 26 becomes 8×100 pl=800 pl.

<Allocation of Nozzles to Inner-Side Nozzles and Outer-Side Nozzles>

Figure 7:
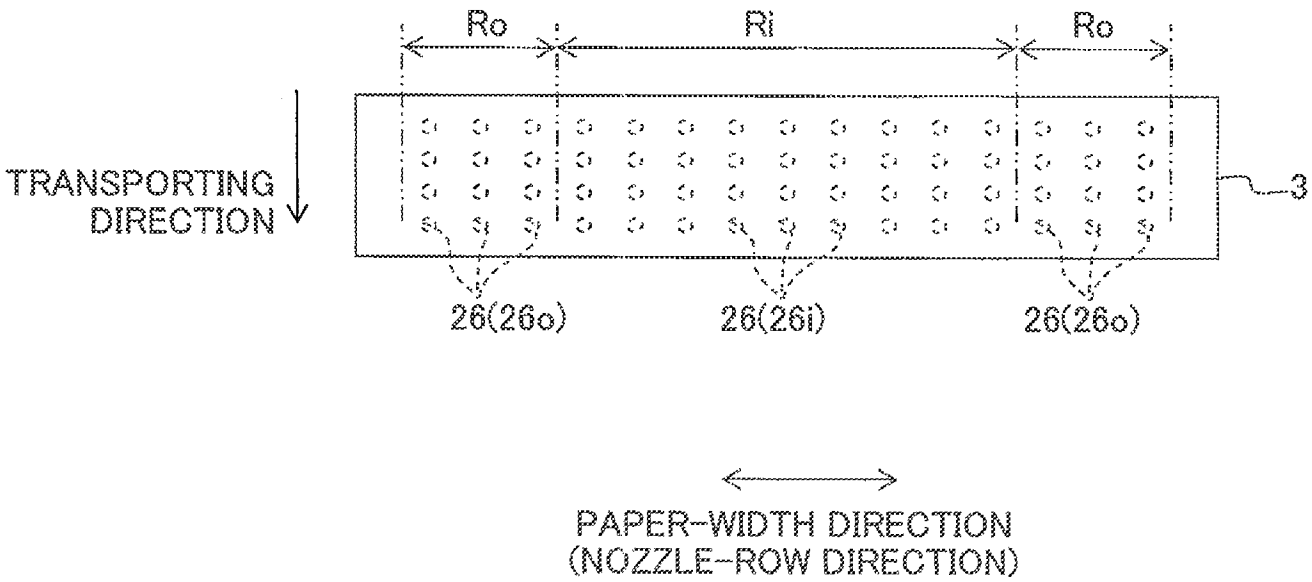
FIG. 7 is a diagram describing an allocation of nozzles to inner-side nozzles and outer-side nozzles of the ink-jet head.

Next, each of the plurality of nozzles 26 is allocated to either an inner-side nozzle 26*i* which is positioned at an inner side in the direction of arrangement in row of nozzles or an outer-side nozzle 26*o* which is positioned at an outer side of the inner-side nozzle 26*i* (step S2). FIG. 7 is a diagram describing an allocation of nozzles to inner-side nozzles and outer-side nozzles. In an example in FIG. 7, out of the nozzles 26 belonging to one nozzle row 39, three nozzles 26 positioned on a left side in a range Ro and three nozzles 26 positioned on a right side in the range Ro are allocated to the outer-side nozzles 26*o*. The rest of the nozzles 26 positioned on a central side in the range Ri are allocated to the inner-side nozzles 26*i*.

For the nozzle 26 positioned on the outer side in the direction of arrangement in row of nozzles, the ink inside the nozzle 26 is more susceptible to thickening compared to the nozzle 26 positioned on an inner side. Therefore, the controller 6 makes the flushing amount for the nozzle allocated to the outer-side nozzle 26*o* more than the basic flushing amount.

Moreover, the controller 6 makes a change of as to whether to allocate each nozzle 26 to the inner-side nozzle 26*i* or to allocate each nozzle 26 to the outer-side nozzle 26*o*, according to an operation status of the printer 1. Concrete examples are cited in the following items (a), (b), and (c). The controller 6 changes the range Ro of the outer-side nozzles 26*o* either by selecting appropriately any one or by combining two or more of the following items (a) to (c).

<(a) Change According to Humidity Information>

In a case in which a humidity of an atmosphere around the ink-jet head 3 is low, for the nozzles 26 over wider range, the drying of ink is susceptible to occur. Therefore, the controller 6 increases the number of nozzles 26 to be allocated to the outer-side nozzles 26*o* by increasing the range Ro in inverse proportion to the humidity detected by the humidity sensor 31, or in other words, lower the humidity, larger is the number of nozzles 26 allocated to the outer-side nozzles 26*o* by increasing the range Ro.

<(b) Change According to Temperature Information>

In a case in which a temperature around the ink-jet head 3 is high, the humidity of the atmosphere around the ink-jet head 3 becomes low even when the amount of ink jetted from the ink-jet head 3 at the time of recording operation is same. Therefore, the controller 6 increases the number of nozzles 26 to be allocated to the outer-side nozzles 26*o* by increasing the range Ro in an inverse proportion to the temperature detected by the temperature sensor 30, or in other words, lower the temperature, larger is the number of nozzles 26 allocated to the outer-side nozzles 26*o* by increasing the range Ro.

The range Ro of the outer-side nozzles 26*o* may be determined only by the information of humidity detected by the humidity sensor 31 as in the aforementioned item (a). Moreover, the range Ro of the outer-side nozzles 26*o* may also be determined by using information of temperature detected by the temperature sensor 30 as supplementary information in addition to the information of humidity. Furthermore, the information of temperature detected by the temperature sensor 30 is necessary not only for changing the range of allocation to the outer-side nozzles 26*o* described here, but also for various processing of the printer 1, such as estimating the temperature of ink. The information of temperature detected by the temperature sensor 30 for such application may also be used as a substitute for the information of humidity. In this case, the humidity sensor 31 may not be provided.

<(c) Change According to Amount of Ink Jetted at the Time of Recording Operation>

Smaller the amount of ink jetted on to the recording paper 100 by the ink-jet head 3 at the time of recording operation, lower is the atmospheric humidity near each nozzle 26. Therefore, the number of nozzles 26 to be allocated the outer-side nozzles 26*o* is to be increased by making the range Ro large, in an inverse proportion of the amount of ink jetted per unit time by the ink-jet head 3 at the time of recording operation, or in other words, smaller the amount of ink jetted per unit time by the ink-jet head 3, larger is the number of nozzles 26 to be allocated to the outer-side nozzles 26*o* by increasing the range Ro.

<Carrying Out Flushing>

Next, the controller 6 controls the driver IC 47 that drives the piezoelectric actuator 19, and makes the ink-jet head 3 carry out flushing for the plurality of nozzles 26 (step S3). At this time, for the nozzles 26 allocated to the inner-side nozzles 26*i* at step S2, the flushing is carried out by the basic flushing amount. Whereas, for the nozzles 26 allocated to the outer-side nozzles 26*o* at step S2, the flushing is carried out by the flushing amount larger than the basic flushing amount.

The following method can be cited as a concrete method for making the flushing amount for the outer-side nozzles 26*o* to be larger than the basic flushing amount. For instance, the controller 6 holds information of an amount to be added to the basic flushing amount, of the flushing amount of the outer-side nozzle 26*o*, in the ROM 35. The controller 6 determines the final flushing amount by adding the amount to be added to the basic flushing amount, for the nozzles 26 which are allocated to the outer-side nozzles 26*o*. Or, the controller 6 may hold information of a multiplying factor with respect to the basic flushing amount, instead of the amount to be added, in the ROM 35. In this case, the controller 6 determines the final flushing amount by multiplying the basic flushing amount by the multiplying factor, for the nozzles 26 which are allocated to the outer-side nozzles 26*o*.

Moreover, in a case in which information of the amount of the basic flushing amount includes the size of liquid droplets and the number of flushings, the controller 6 may make the size of liquid droplets large, or, may make the number of flushings large for the nozzles which are allocated to the outer-side nozzles 26*o*. For making the size of liquid droplets large for the outer-side nozzles 26*o*, it is preferable to make the following arrangement for example. Assume that the driver IC 47 has an arrangement which enables to supply selectively drive signals of a plurality of types corresponding to the sizes of liquid droplets of plurality of types, to each individual electrode 42. For instance, the drive signals of plurality of types have different drive waveforms and different drive voltages. On that basis, the controller 6 makes supply a drive signal corresponding to the size of liquid droplets larger than the size of liquid droplets in the information of the basic flushing amount, from the driver IC 47 to the individual electrode 42 corresponding to that nozzle 26 which has been allocated to the outer-side nozzle 26*o*.

In the embodiment described above, for the inner-side nozzles 26*i*, the flushing is carried out with the basic flushing amount for each nozzle 26. Whereas, for the outer-side nozzles 26*o*, the flushing is carried out with the flushing amount larger than the basic flushing amount. Accordingly, it is possible to make the flushing amount larger for the outer-side nozzles 26*o* in which the thickening of ink is faster as compared to the thickening of ink in the inner-side nozzles 26*i*, and it is possible to discharge the thickened ink assuredly. Moreover, the flushing amount is not increased for all the nozzles 26 but the flushing amount is made larger than the basic flushing amount only for the outer-side nozzles 26*o*. Accordingly, it is possible to prevent an unnecessary discharge of a large amount of ink in the flushing of the inner-side nozzles 26*i*, and to suppress the amount of waste ink due to flushing, to be small.

Moreover, the number of nozzles 26 allocated to the outer-nozzles 26*o* at the time of flushing is changed according to an operation status of the printer at the time of carrying out flushing. Accordingly, optimization of flushing in accordance with the operation status of the printer 1 such that the amount of waste liquid due to flushing becomes as small as possible, while discharging the thickened ink inside each nozzle 26, becomes possible.

Moreover, the following effect is also achieved by making the flushing amount of the outer-side nozzle 26*o* large. When the ink is made to be discharged from each nozzle 26 by driving each piezoelectric element 48 of the piezoelectric actuator 19 by the driver IC 47, heat is generated by an actuation of the piezoelectric element 48. Larger the jetting energy imparted to the ink inside the nozzle 26 by the piezoelectric element 48, or in other words, larger the amount of ink droplets jetted from the nozzle 26, larger is an amount of the heat generated.

The heat generated at the time of actuating the piezoelectric actuator 48 is transmitted to the ink inside the channel unit 18. Here, the heat is susceptible to be radiated in an outer-side portion in the direction of arrangement in row of nozzles of the ink-jet head 3, or in other words, two end portions in a leftward-rightward direction of the ink-jet head 3, whereas, the heat is susceptible to be accumulated in the inner-side portion of the ink-jet head 3. Consequently, due to a difference in the amount of heat radiated inside and outside, the temperature of the ink on the outer-side portion of the ink-jet head 3 is susceptible to be lower than the temperature of the ink flowing through the inner-side portion in the direction of arrangement in row of nozzles. From this point of view, in the embodiment, the flushing amount is larger than the basic flushing amount for the outer-side nozzles 26*o*. Therefore, the heat generated in the actuation of the piezoelectric element 48 becomes more on the outer-side portion than on the inner-side portion of the ink-jet head 3. Accordingly it is possible to suppress a variation in the difference of temperature of ink between the outer-side portion and the inner-side portion of the ink-jet head 3, to be small.

The printer 1 in the embodiment described above corresponds to a 'liquid jetting apparatus' of the present teaching. The ink-jet head 3 corresponds to a 'liquid jetting head' of the present teaching. The transporting mechanism 4 corresponds to a 'transporting mechanism' of the present teaching. The controller 6 corresponds to a 'controller' of the present teaching. The piezoelectric element 48 corresponds to a 'pressure generating element' of the present teaching. The recording paper 100 corresponds to a 'medium' of the present teaching. The humidity sensor 31 corresponds to a 'humidity sensor' of the present teaching. The temperature sensor 30 corresponds to a 'temperature sensor' of the present teaching.

Next, modified embodiments in which various modifications are made in the embodiment will be described below. However, same reference numerals are assigned to components having a similar structure as in the embodiment, and description of such components is omitted appropriately.

In a case in which two or more than two nozzles 26 are allocated to the outer-side nozzles 26*o*, the setting may be carried out such that the flushing amount differs for the plurality of outer-side nozzles 26*o*. For instance, the setting may be made such that, farther on the outer side the position of the nozzle of the outer-side nozzles 26*o*, larger is an amount of increase in the flushing amount with respect to the basic flushing amount. The amount of increase with respect to the basic flushing amount is the amount to be added to or the multiplying factor to be multiplied by with respect to the basic flushing amount, as mentioned in the embodiment.

In some cases, there is a difference in susceptibility to thickening of ink between the outer-side nozzle 26*o* positioned at one end side in the direction of arrangement in row of nozzles of the ink-jet head 3 and the outer-side nozzle 26*o* positioned at the other end side in the nozzle-row direction of the ink-jet head 3. In such case, the setting may be carried out such that the amount of increase with respect to the basic flushing amount, of the flushing amount for these two outer-side nozzles 26*o* differs.

In FIG. 1 of the embodiment, the ink-jet head 3 of line type is accommodated inside the casing 7. A wall portion of the casing 7 is arranged one each on a right side and a left side in the direction of arrangement in row of nozzles of the ink-jet head 3. In FIG. 1, between a right end portion of the ink-jet head 3 and the wall portion of the casing 7, there exists a space wider than a space between a left end portion of the ink-jet head 3 and the wall portion of the casing 7. In a case in which a device for maintenance of the ink-jet head 3 such as a wiper, and a waste liquid tank etc. are arranged on the right side of the ink-jet head 3, the arrangement as mentioned above is realized.

Figure 8:
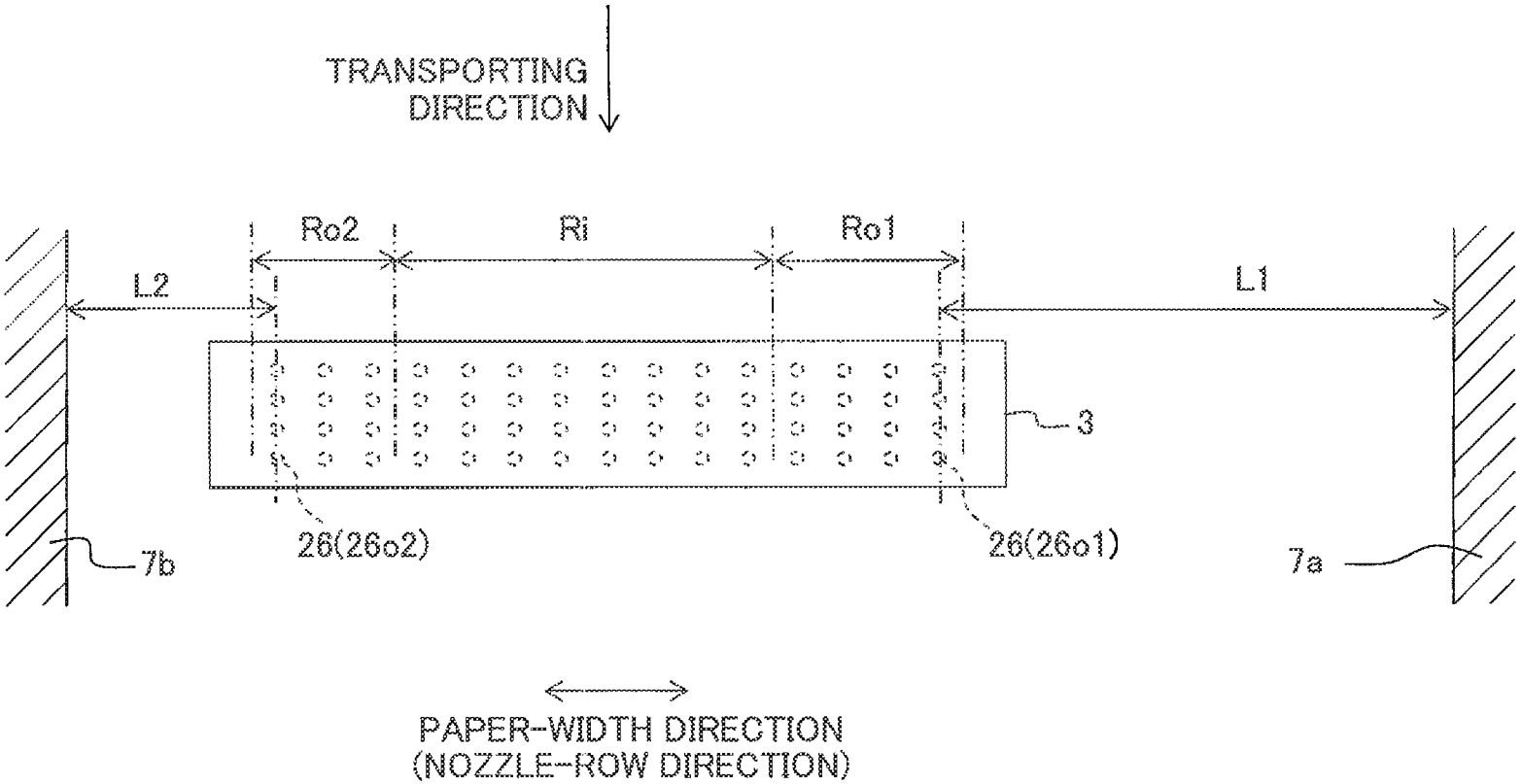
FIG. 8 is a diagram showing a distance between an ink-jet head and two wall portions of a casing according to a modified embodiment 2.

When the abovementioned arrangement is shown more concretely, it is as follows. As shown in FIG. 8, a distance L1 between a first outer-side nozzle 26*o*1 positioned at the extreme right end and a first wall portion 7*a* of the casing 7 becomes longer than a distance L2 between a second outer-side nozzle 26*o*2 positioned at the extreme left end and a second wall portion 7*b* of the casing 7. In this case, there is a large space between the first outer-side nozzle 26*o*1 and the first wall portion 7*a*. Therefore, air is susceptible to flow convectively through this space, and humidity becomes comparatively lower. Whereas, the space between the second outer-side nozzle 26*o*2 and the second wall portion 7*b* is small. Therefore, damp air is susceptible to be accumulated, and the humidity becomes high. For this reason, the controller 6 is capable of making the amount of increase with respect to the basic flushing amount, of the flushing amount for the first outer-side nozzle 26*o*1 of which the distance up to the first wall portion 7*a* is far, larger than the amount of increase with respect to the basic flushing amount, of the flushing amount for the second outer-side nozzle 26*o*2 of which, the distance up to the second wall portion 7*b* is near.

Moreover, as shown in FIG. 8, in a range Ro1 of the outer-side nozzle 26*o* on the right end side of the ink-jet head 3, the distance up to the first wall portion 7*a* is long. Therefore, for the reason similar to the aforementioned reason, the range Ro1 of the outer-side nozzle 26*o* on the right end side of the ink-jet head 3 may be made larger than a range Ro2 of the outer-side nozzle 26*o* on the left end side of the ink-jet head 3. In other words, the number of nozzles 26 to be allocated to the outer-side nozzles 26*o* on the right side may be let to be larger than the number of nozzles 26 to be allocated to the outer-side nozzles 26*o* on the right side.

A factor contributing to a difference in susceptibility to drying of ink in the nozzles 26 on two end sides in the direction of arrangement in row of nozzles of the ink-jet head 3 is not restricted to the difference in the distance up to the wall portion of the casing 7 as shown in FIG. 7. For example, a source of heat generation such as a motor arranged on one side of the ink-jet head 3, or, a movable body which generates a strong air flow can also be considered as a contributing factor.

According to a recording mode of the printer 1, sometimes, only a part of the nozzles 26 of the ink-jet head 3 are used. For instance, in a case of recording an image on the recording paper 100 having a small paper width, only a part of the nozzles 26 corresponding to that paper width are used. Moreover, in low-resolution printing, since an image is formed by thinning dots, the number of nozzles 26 to be used becomes smaller as compared to the number of nozzles in high-resolution printing. In such manner, in a case in which only a part of the nozzles 26 might be used in the recording operation of the ink-jet head 3, the thickening of ink is susceptible to be faster in the nozzles 26 positioned on the outer side of the part of the nozzles 26 being used. Therefore, it is possible to allocate the part of the nozzles 26 to the outer-side nozzles 26*o* and the inner-side nozzles 26*i*.

Figure 9:
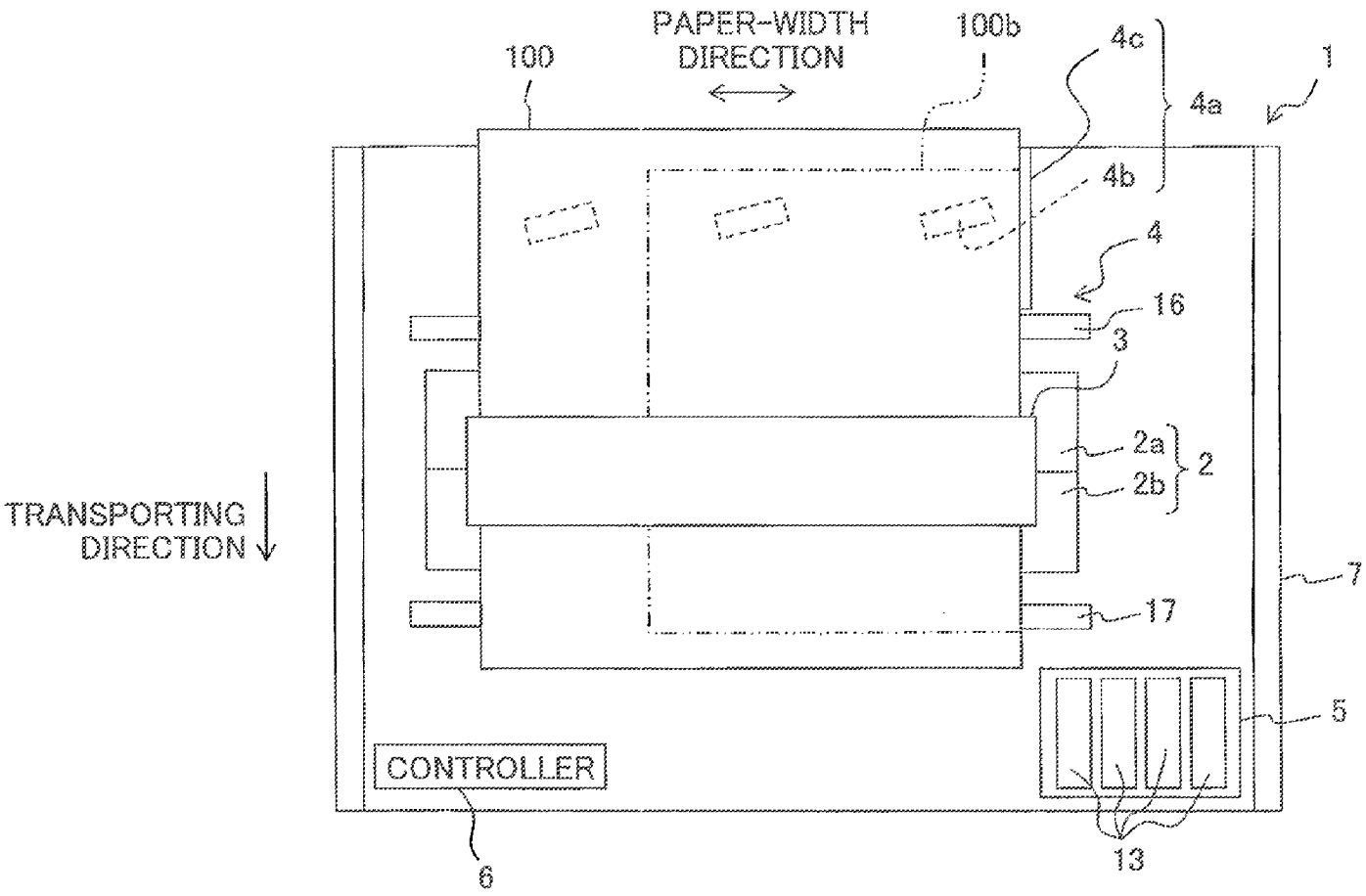
FIG. 9 is a schematic plan view of a printer according to a modified embodiment 3.

In FIG. 9, the transporting mechanism 4 is capable of transporting two types of papers namely, a first recording paper 100*a*, and a second recording paper 100*b* having the paper width smaller than the paper width of the first recording paper 100*a*. It is possible to carry out switching of the first recording paper 100*a* and the second recording paper 100*b* as follows.

Figure 5:
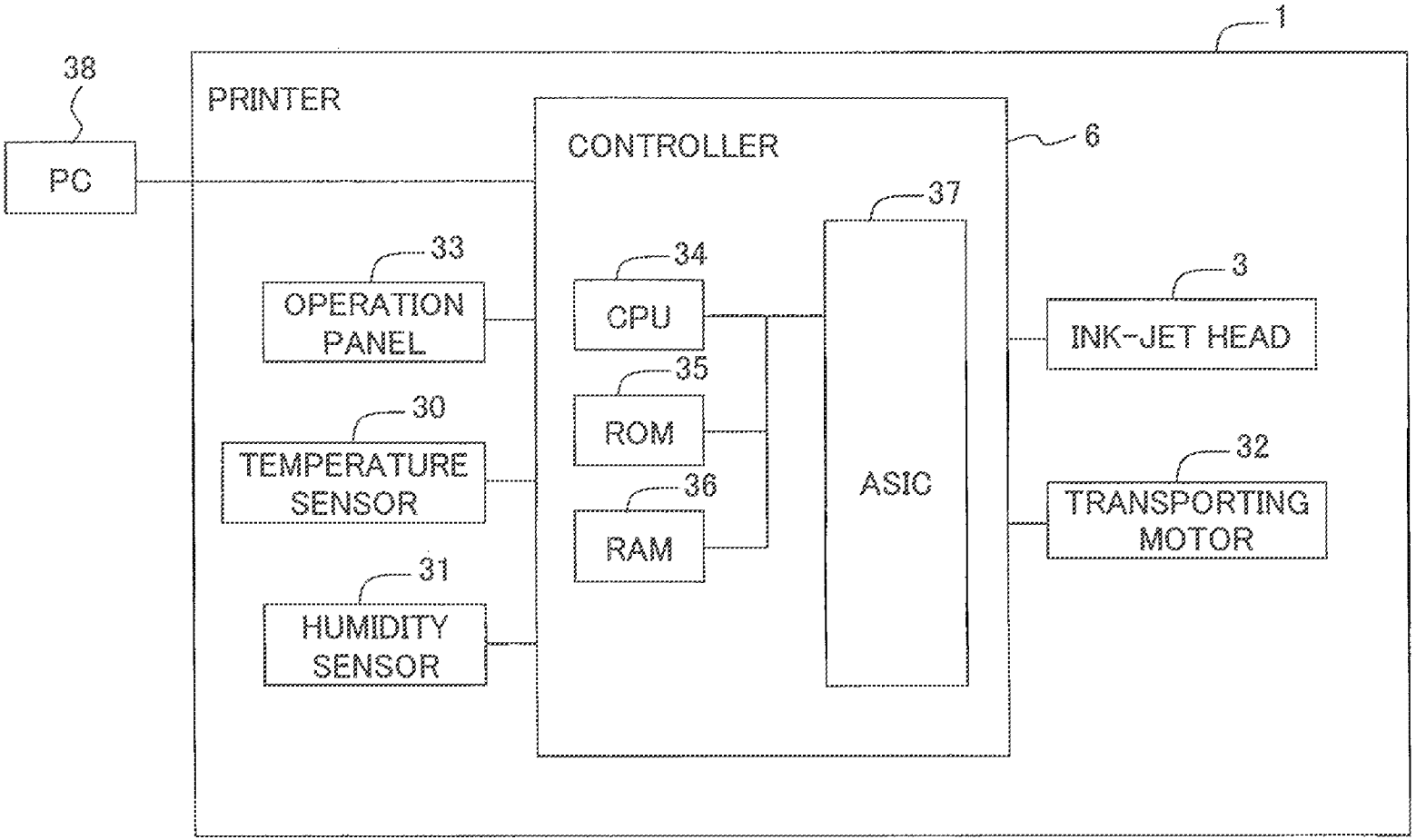
FIG. 5 is a block diagram showing schematically an electrical configuration of the printer.

It is not shown in the diagram, but the paper feeding mechanism which feeds the recording paper 100 to the transporting mechanism 4 includes paper feeding cassettes which accommodate the first recording papers 100*a* and the second recording paper 100*b*, and a pickup roller which draws upon selecting from the first recording paper 100*a* and the second recording paper 100*b* from the paper feeding cassette. The controller 6 controls the pickup roller in accordance with information of a type of paper that has been sent from the PC 38 (refer to FIG. 5), and makes draw one of the first recording paper 100*a* and the second recording paper 100*b*. Moreover, the transporting mechanism 4 includes a paper positioning mechanism 4*a* includes skew rollers 4*b* and a guide surface 4*c*, as shown in FIG. 9. A rotational shafts of the feed roller 16 and the discharge roller 17 are perpendicular to the guide surface 4*c*, and the feed roller 16 and the discharge roller 17 transport the recording paper 100*a* (100*b*) in the transporting direction. Each of the skew rollers has an outer circumferential surface in a columnar shape. Each of the skew rollers rotates in association with the transport of the recording paper 100 and has a rotational shaft which is inclined with respect to the rotational shafts of the feed roller 16 and the discharge roller 17 on that the recording paper 100*a* (100*b*) can be drawn to the side of the guide surface 4*c*. This construction enables the registration of the recording paper 100*a* (100*b*). In FIG. 9, the second recording paper 100*b* is transported in the transporting direction by the transporting mechanism 4, in a state of being drawn (positioned) toward a right end of the ink-jet head 3, or in other words, toward a right side of a range in which the plurality of nozzles 26 is arranged in a row. The first recording paper 100*a* corresponds to a first medium of the present teaching, and the second recording paper 100*b* corresponds to a second medium of the present teaching.

Figure 10:
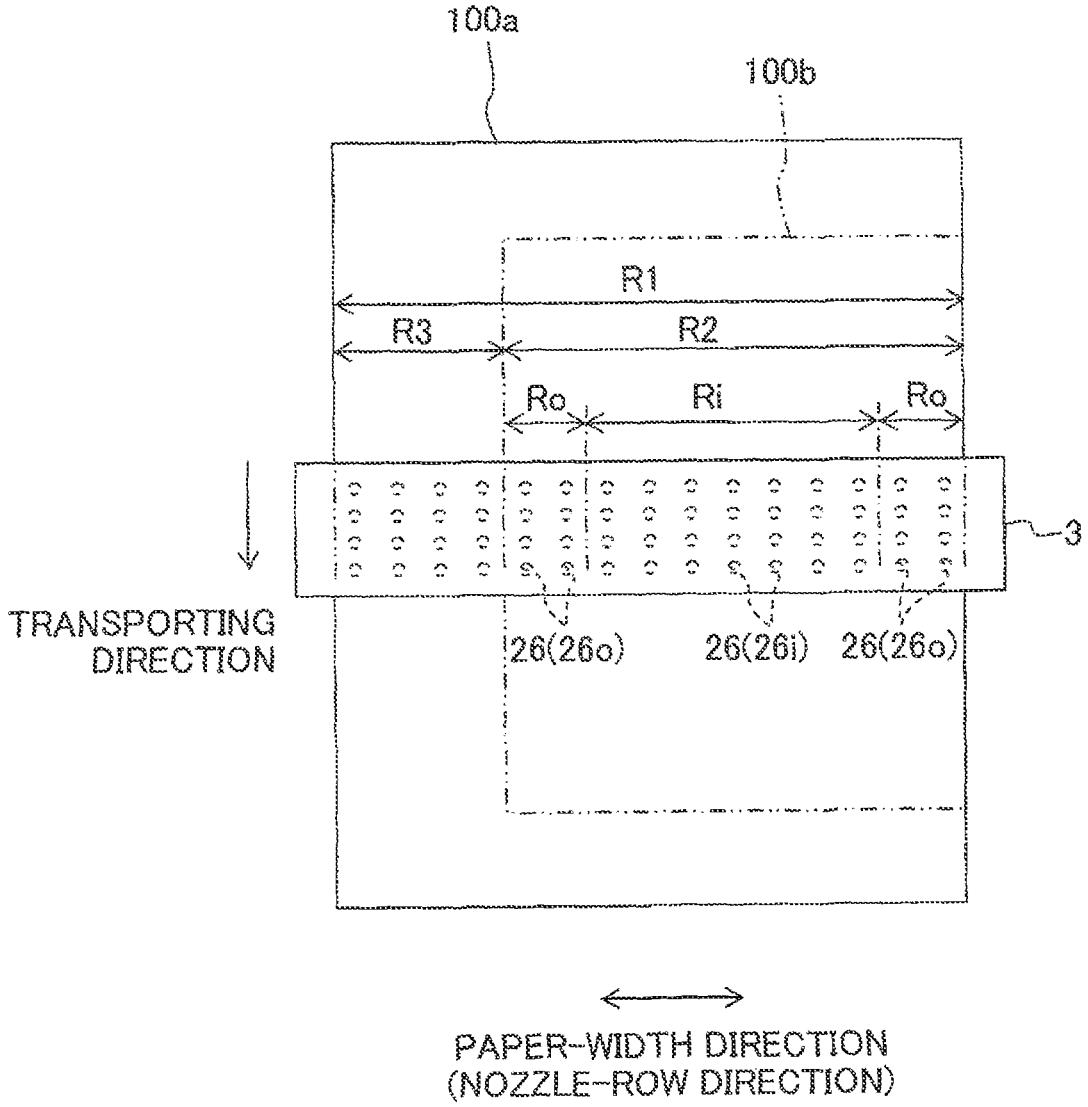
FIG. 10 is a diagram showing an example of allocation of nozzles to inner-side nozzles and outer-side nozzles of the modified embodiment 3.
Figure 11:
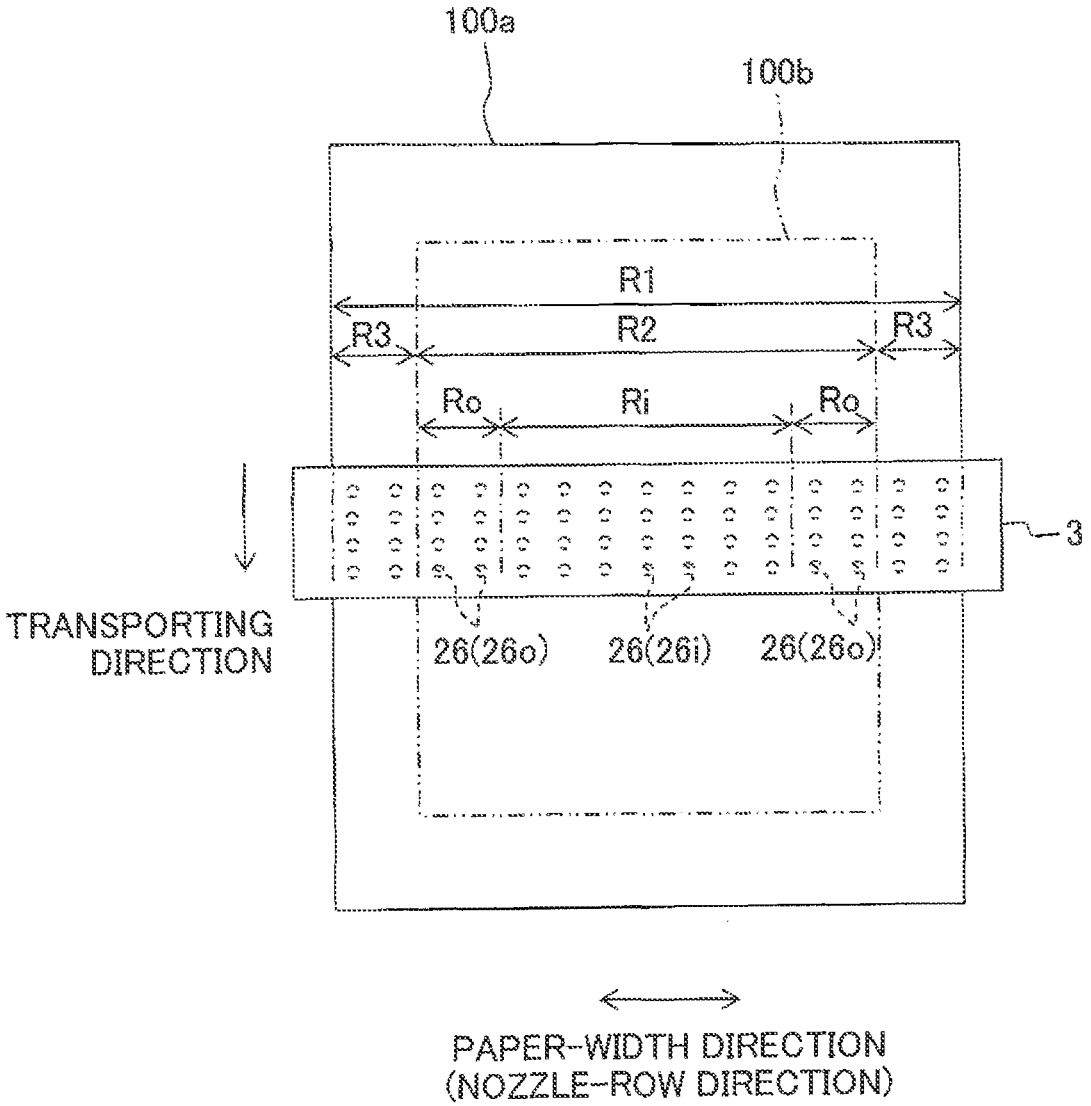
FIG. 11 is a diagram showing another example of allocation of nozzles to the inner-side nozzles and the outer-side nozzles of the modified embodiment 3.

In FIG. 10, the ink-jet head 3 may use all the nozzles 26 in a range R1 of row arrangement (hereinafter, 'row-arrangement range R1') in the recording operation on the recording paper 100*a* with a large paper width. Here, a width of the row-arrangement range R1 is almost same as the width of the first recording paper 100*a*. Whereas, in the recording operation on the recording paper 100*b* with a small paper width, the ink-jet head 3 may use only the nozzles 26 in a partial range R2 which is almost same as the width of the second recording paper 100*b*, and smaller than the row-arrangement range R1. Moreover, in a case in which it has been figured out that the second recording paper 100*b* is to be used in the subsequent recording operation according to the information of the type of paper sent from the PC 38, the controller 6 is capable of allocating the nozzles 26 to the outer-side nozzles 26*o* and the inner-side nozzles 26*i* in the partial range R2 for the flushing to be carried out prior to the recording operation.

When the recording paper 100 that is transported is switched from the second recording paper 100*b* to the first recording paper 100*a* having a large width, the number of nozzles 26 that may jet the inks increases. Concretely, in FIG. 10, the nozzles 26 in a range R3 which were not used for recording on the second recording paper 100*b* may also be used in addition to the nozzles 26 in the range R2. The nozzles 26 in the range R3 not being used for the recording operation on the second recording paper 100*b* carried till that time are considered to have more thickening of ink than the nozzles 26 in the range R2. Therefore, in the flushing prior to the recording operation on the first recording paper 100*a*, it is preferable to make the flushing amount of the nozzles 26 in the range R3 to be larger than the flushing amount of the nozzles 26 in the range R2.

Concretely, in a case in which it has been figured out that the type of the recording paper 100 is to be switched from the second recording paper 100*b* to the first recording paper 100*a* for the subsequent recording operation according to the information of the type of paper sent from the PC 38, the controller 6 makes the flushing amount of the nozzles in the range R3 larger than the flushing amount of the nozzles 26 in the range R2 before switching of the recording paper 100.

In FIG. 9 and FIG. 10, the description has been made by citing an example of an arrangement in which the second recording paper 100*b* is transported upon drawing (positioning) toward the right side of the row-arrangement range R1 of the nozzles 26. However, an arrangement may be such that, the second recording paper 100*b* is transported upon positioning to center of the row-arrangement range R1. Even in such case, the allocation of nozzles 26 in the range R2 is similar.

As shown in FIG. 9, it is possible to make a setting such that, in a case in which the second recording paper 100*b* is transported upon positioning toward one of the sides of the row-arrangement range R1 of the nozzles 26, an amount of increase in the flushing amount with respect to the basic flushing amount differs for the nozzles 26 on one end side in the partial range R2 and the nozzles 26 on the other end side in the partial range R2.

In FIG. 10, out of the nozzles 26 in the range R2 that may be used for the second recording paper 100*b*, the nozzles 26 positioned on a side opposite to the side to which the second recording paper 100*b* is drawn, or in other words, the nozzles positioned in a range Re on a left-end side of FIG. 12 are positioned at an outer side, of the nozzles 26 in the range R2. In other words, for the nozzles 26 in the range Ro on the left-end side, the ink is not jetted from the nozzles 26 on the left side of the range Ro, but the nozzles 26 in the range Re on the left-end side are positioned at the center of the row-arrangement range R1. Therefore, the environmental humidity in the vicinity of the nozzles 26 becomes comparatively higher. Therefore, the amount of increase in the flushing amount with respect to the basic flushing amount of the nozzles 26 in the range Ro on the left-end side is made smaller as compared to the amount of increase for the nozzles 26 in the range Ro on the right-end side.

Moreover, sometimes, a ratio of the range R2 that may be used for the second recording paper 100*b* with respect to the row-arrangement range R1 is smaller than a certain ratio (such as 0.7). Here, the nozzles 26 in the range Ro on the left-end side are positioned at a central portion when viewed in the row-arrangement range R1. In this case, the flushing of the nozzles 26 in the range Ro on the left-end side may be carried out with the basic flushing amount same as for the nozzles 26 which have been allocated to the inner-side nozzles 26*i*. In other words, the amount of increase may be 0. Whereas, sometimes, the ratio of the range R2 with respect to the row-arrangement range R1 is not smaller than the certain ratio. Here, the nozzles 26 in the range Ro on the left-end side are at positions drawn somewhat toward the left side when viewed in the row-arrangement range R1. In this case, the amount of increase in the flushing amount for the nozzles 26 in the range Ro on the left-end side may be let to be a value smaller than the amount of increase in the flushing amount for the nozzles 26 in the range Ro on the right-end side, but a value larger than 0.

In the recording operation of the ink-jet head 3, when the number of nozzles 26 that may be used is small, the amount of ink jetted from the ink-jet head 3 also becomes small. Consequently, the environment humidity in the vicinity of each nozzle 26 becomes low. Therefore, the ratio of the outer-side nozzles 26*o* to the number of nozzles 26 that may be used may be let to be in inverse proportion of the number of nozzles 26 that may be used (smaller the number of nozzles 26 that may be used, higher is the ratio of the outer-side nozzles 26*o* to the number of nozzles 26 that may be used).

Figure 12A:
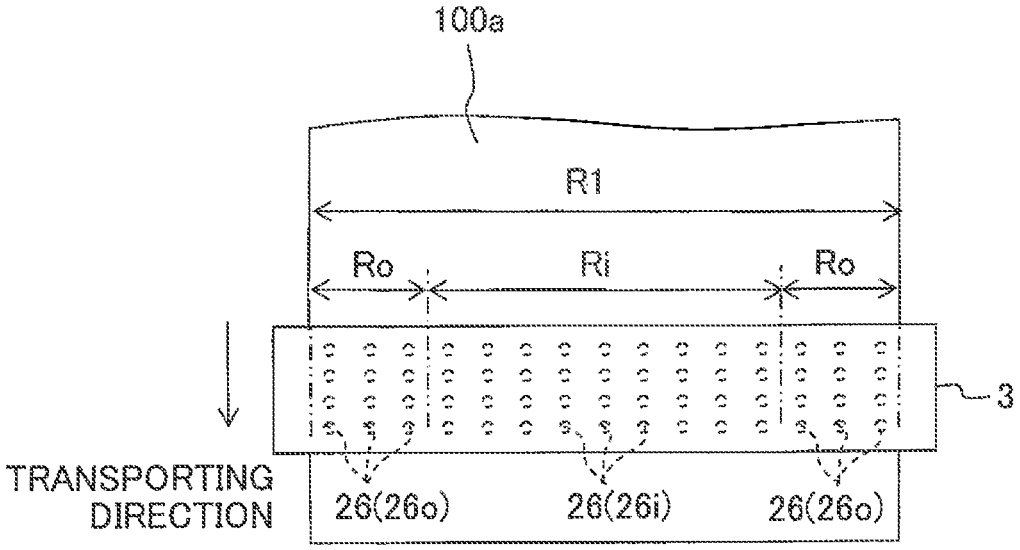
FIG. 12A and FIG. 12B are diagrams showing allocation of nozzles to inner-side nozzles and outer-side nozzles of a modified embodiment 5.
Figure 12B:
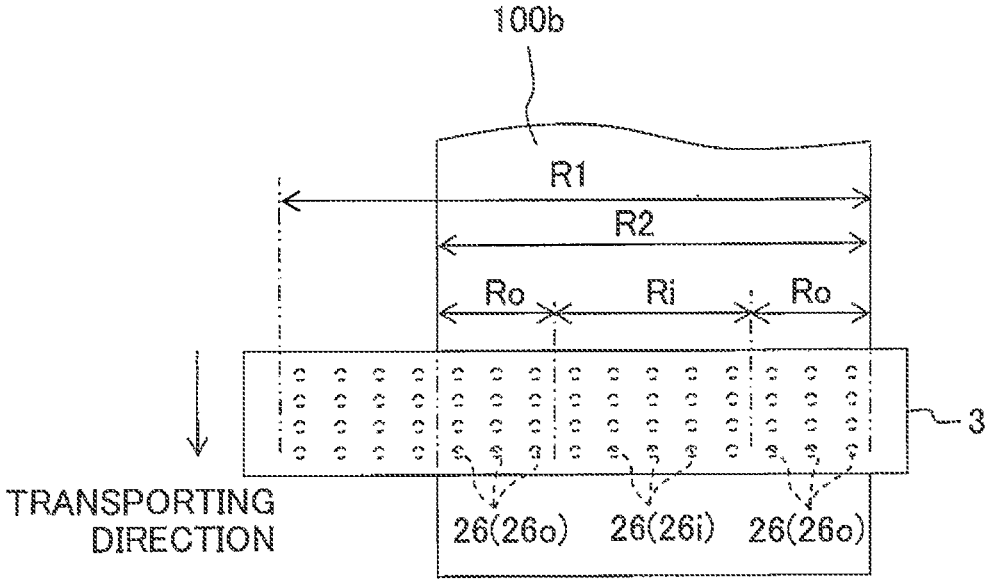

In the example shown in FIG. 12A, in the flushing when the first recording paper 100*a* is transported, the number of the inner-side nozzles 26*i* in a range Ri in the direction of arrangement in row of nozzles is nine, and the number of outer-side nozzles 26*o* on the left side and the right side in a range Ro in the direction of arrangement in row of nozzles is six. Therefore, the ratio of the outer-side nozzles 26*o* with respect to the fifteen nozzles 26 in the range R1 that may be used is $6/15=0.4$. Whereas, in the example shown in FIG. 12B, in the flushing when the second recording paper 100*b* is transported, the number of inner-side nozzles 26*i* in the direction of arrangement in row of nozzles is five, and the number of outer-side nozzles 26*o* on the left side and the right side is six. Therefore, the ratio of the outer-side nozzles 26*o* with respect to the eleven nozzles 26 in the range R2 that may be used is $6/11=0.55$.

In the embodiment, the nozzles 26 were allocated to the inner-side nozzles 26*i* and the outer-side nozzles 26*o* in the direction of arrangement in row of nozzles. However, the susceptibility to thickening of the ink caused due to the difference in humidity differs for the nozzle row 39 positioned at an inner side in the transporting direction of the ink-jet head 3 and the nozzle row 39 positioned at an outer side in the transporting direction of the ink-jet head 3. Therefore, the nozzles may be allocated to the outer side and the inner side in the transporting direction.

Figure 13:
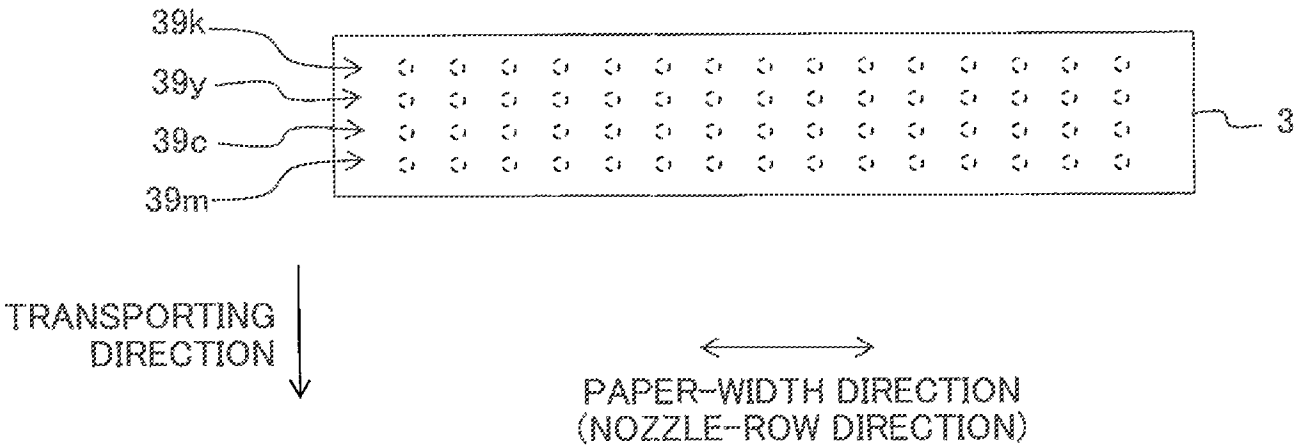
FIG. 13 is a diagram describing division of inner-side nozzles and outer-side nozzles in a transporting direction of a modified embodiment 6.

In an example in FIG. 13, the four nozzle rows 39 which jet inks of four colors respectively are arranged to be lined up in order of the nozzle row 39*k*, the nozzle row 39*y*, the nozzle row 39*c*, and the nozzle row 39*m* from an upstream side of the transporting direction. In this case, in FIG. 13, the nozzles 26 belonging to each of the nozzle rows 39*y* and 39*c* positioned at the inner side in the transporting direction are the inner-side nozzles 26*i*. Moreover, the nozzles 26 belonging to each of the nozzle rows 39*k* and 39*m* positioned at the outermost side in the transporting direction are the outer-side nozzles 26*o*. Moreover, similarly as aforementioned in the embodiment, for the nozzles 26 which are the inner-side nozzles 26*i*, it is possible to carry out the flushing with the basic flushing amount, and for the nozzles 26 which are the outer-side nozzles 26*o*, it is possible to carry out the flushing with the flushing amount larger than the basic flushing amount.

Furthermore, the susceptibility to thickening of the ink in the nozzles 26 is considered to be different for the upstream side of the transporting direction and the downstream side of the transporting direction. At the upstream side of the transporting direction, an air current flows in with the recording paper 100 that is transported. Therefore, the ink is susceptible to thickening in the nozzles 26 belonging to the nozzle row 39 at the upstream side. Whereas, at the downstream side of the transporting direction, damp air is discharged together with the recording paper 100 due to jetting of the ink from the plurality of nozzles 26. Therefore, the environmental humidity in the vicinity of the nozzle row 39 at the downstream side becomes high, and the ink inside the nozzle 26 is not susceptible to thickening.

In view of this, in FIG. 13, the controller 6 may make the amount of increase in the flushing amount with respect to the basic flushing amount for the nozzle 26 belonging to the nozzle row 39*m* positioned at the downstream side of the transporting direction smaller as compared to the amount of increase in the flushing amount for the nozzle 26 belonging to the nozzle row 39*k* at the upstream side of the transporting direction. For instance, while allocating the nozzles 26 in the nozzle row 39*k* at the upstream side of the transporting direction to the outer-side nozzle 26*o* on one side, the flushing may be carried out with the basic flushing amount for the nozzles 26 belonging to the nozzle row 39 at the downstream side of the transporting direction, similarly as for the nozzles 26 belonging to the nozzle rows 39*y* and 39*c* on the inner side.

Figure 14:
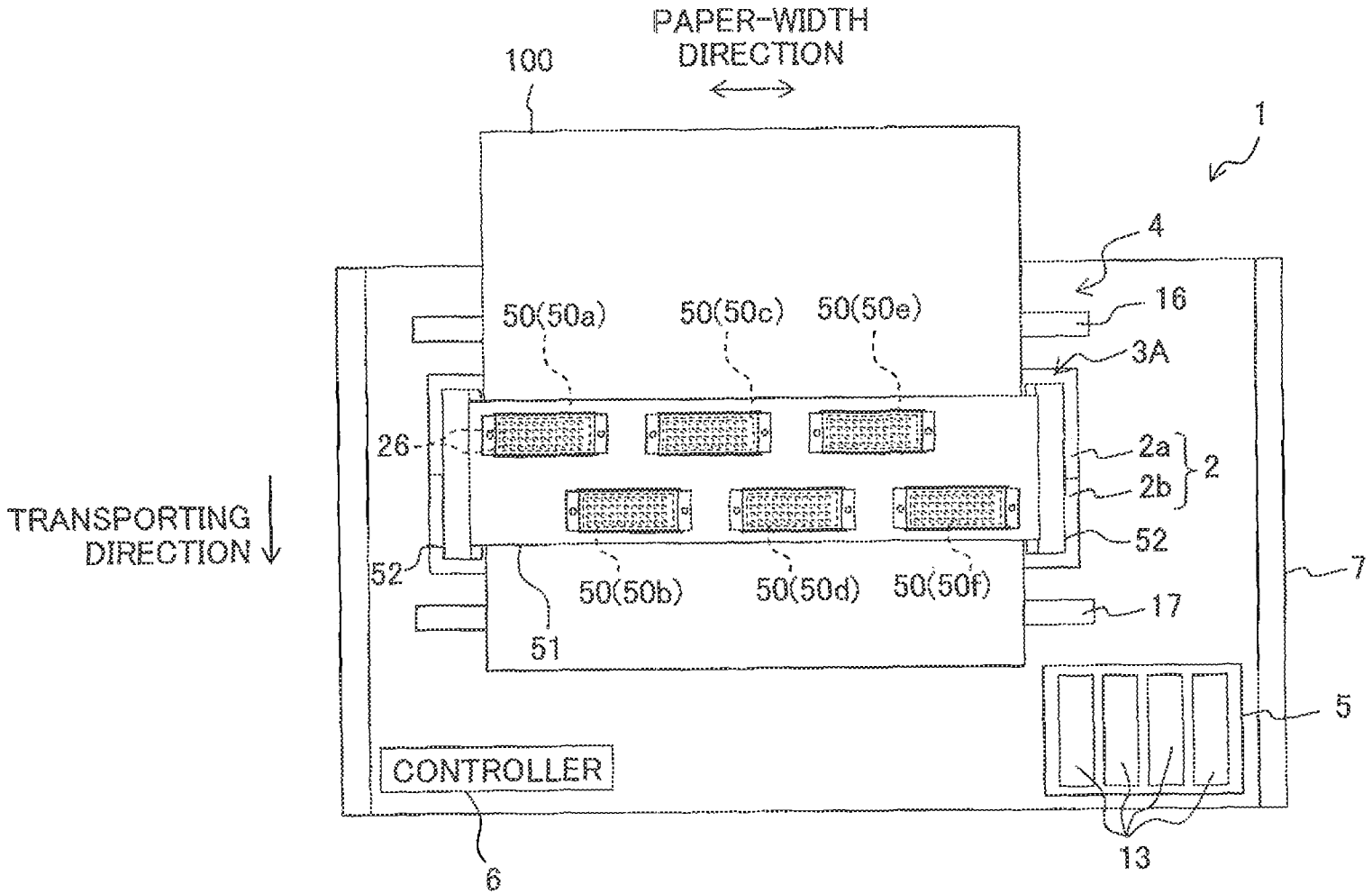
FIG. 14 is a schematic plan view of a printer according to a modified embodiment 7.

The ink-jet head 3 may have a plurality of head units combined together, with each head unit having a plurality of nozzles 26. As shown in FIG. 14, an ink-jet head 3A includes six head units 50 (50*a*, 50*b*, 50*c*, 50*d*, 50*e*, and 50*f*) lined up in a zigzag form along the direction of width of paper. The six head units 50 are installed on a head holder 51 in the form of a plate. The head holder 51 is supported in a horizontal posture by two supporting members 52, one on a left side and one on a right side respectively. Each head unit 50 includes the plurality of nozzles 26 arranged in rows along the direction of width of paper, and forms four nozzle rows, and a piezoelectric actuator not shown in the diagram, which makes jet the ink from each of the plurality of nozzles 26.

Even in the ink-jet head 3A in FIG. 14, the nozzles 26 are divided into the inner-side nozzles 26*i* and the outer-side nozzles 26*o* similarly as in the ink-jet head 3 of the embodiment. In other words, from among all the nozzles 26 of the ink-jet head 3A, the nozzles 26 positioned at the inner side in the direction of arrangement in row of nozzles are allocated to the inner-side nozzles 26*i*, and the nozzles 26 positioned at the outer side in the direction of arrangement in row of nozzles are allocated to the outer-side nozzles 26*o*. For instance, considering the head unit 50*a* positioned at the extreme left side, the nozzles 26 positioned in a right half of the head unit 50*a* being the nozzles 26 close to the other head units 50*b* and 50*c*, are allocated to the inner-side nozzles 26*i*. Whereas, the nozzles 26 positioned in a left half of the head unit 50*a* being positioned at an outer side in the direction of arrangement in row of nozzles from the nozzles 26 allocated to the inner-side nozzles 26*i*, are allocated to the outer-side nozzles 26*o*.

Moreover, in FIG. 14, the inner-side nozzles 26*i* and the outer-side nozzles 26*o* may be divided into the units of head units 50. For instance, in FIG. 14, all the nozzles 26 of the four head units 50*b*, 50*c*, 50*d*, and 50*e* positioned at the inner side in the direction of arrangement in row of nozzles out of the six head units 50*a* to 50*f*, are the inner-side nozzles 26*i*. Whereas, all the nozzles 26 of the two head units 50*a* and 50*f* positioned on two outer sides respectively are the outer-side nozzles 26*o*. In this embodiment, the four head units 50*b* to 50*e* correspond to the inner-side head unit 50 of the present teaching, and the two head units 50*a* and 50*f* on the two outer sides respectively correspond to the outer-side head unit 50 of the present teaching.

In such manner, by dividing the inner-side nozzles 26*i* and the outer-side nozzles 26*o* in the units of the head unit 50, the control becomes simple. By the control becoming simple, a software design and a hardware design become simple. Moreover, since it is possible to make a circuit structure of the hardware simple, it is possible to reduce material cost. Furthermore, this is effective even against the variation in ink temperature which is caused due to the difference in the amount of heat radiated between the outer-side portion and the inner-side portion of the ink-jet head 3 mentioned briefly. In other words, only by making the flushing amount large for some of the nozzles 26 in the head units 50*a* and 50*f* positioned on the outer side, the rise in temperature of the ink inside the head units 50*a* and 50*f* is small. Whereas, by making the flushing amount large for all the nozzles 26 of the head units 50*a* and 50*f* on the outer side, it is possible to raise substantially the temperature of the ink inside the head units 50*a* and 50*f* on the outer side, and it is possible to suppress the difference in temperature of the ink from the head units 50*h* to 50*e* on the inner side to be small.

Apart from the abovementioned modifications, the following modification is also possible. The ink-jet head 3 of the embodiment is an ink-jet head of line type. However, the present teaching is also applicable to an ink-jet head of a serial type. The ink-jet head of serial type includes a plurality of nozzles arranged in rows in the transporting direction of the recording paper, and makes jet inks on the recording paper while moving in a direction intersecting the transporting direction.

Moreover, a pressure generating element of an ink-jet head, which makes jet the ink from a nozzle, is not restricted to the piezoelectric element 48 of the embodiment. The pressure generating element for instance, may be a heater element which generates pressure by causing film boiling of ink.

The embodiment and the modified embodiments thereof are examples in which, the present teaching is applied to a printer which includes an ink-jet head that jets an ink on to a recording paper. However, the present teaching is applicable to liquid jetting apparatuses for applications other than jetting of ink. For example, the present teaching is also applicable to a liquid jetting apparatus which forms an electroconductive pattern on a surface of a substrate by jetting an electroconductive liquid on to the substrate.

What is claimed is:

1. A liquid jetting apparatus configured to jet a liquid onto a medium, comprising:

a liquid jetting head including:

a plurality of nozzles arranged in rows in a nozzle-row direction; and a plurality of pressure generating elements configured to generate pressure for jetting the liquid from the plurality of nozzles toward the medium;

a controller configured to:

determine a basic flushing amount for each nozzle;

make the liquid jetting head carry out flushing with the basic flushing amount for inner-side nozzles positioned at an inner side in the nozzle-row direction;

make the liquid jetting head carry out flushing with a flushing amount larger than the basic flushing amount, for outer-side nozzles positioned at an outer side in the nozzle-row direction, of the inner-side nozzles; and allocate the nozzles into the outer-side nozzles based on an operation status of the liquid jetting apparatus at the time of carrying out flushing; and a humidity sensor configured to detect a humidity around the liquid jetting head;

wherein the controller is configured to increase the number of nozzles to be allocated to the outer-side nozzles such that lower the humidity that has been detected by the humidity sensor, larger is the number of nozzles allocated to the outer-side nozzles.

2. A liquid jetting apparatus configured to jet a liquid onto a medium comprising:

a liquid jetting head including:

a plurality of nozzles arranged in rows in a nozzle-row direction; and a plurality of pressure generating elements configured to generate pressure for jetting the liquid from the plurality of nozzles toward the medium;

a controller configured to:

determine a basic flushing amount for each nozzle;

make the liquid jetting head carry out flushing with the basic flushing amount for inner-side nozzles positioned at an inner side in the nozzle-row direction;

make the liquid jetting head carry out flushing with a flushing amount larger than the basic flushing amount, for outer-side nozzles positioned at an outer side in the nozzle-row direction, of the inner-side nozzles; and allocate the nozzles into the outer-side nozzles, based on an operation status of the liquid jetting apparatus at the time of carrying out flushing; and a temperature sensor configured to detect a temperature around the liquid jetting head;

wherein the controller is configured to increase the number of nozzles to be allocated to the outer-side nozzles such that higher the temperature detected by the temperature sensor, larger is the number of nozzles allocated to the outer-side nozzles.

3. A liquid jetting apparatus configured to jet a liquid onto a medium, comprising:

a liquid jetting head including:

a plurality of nozzles arranged in rows in a nozzle-row direction; and a plurality of pressure generating elements configured to generate pressure for jetting the liquid from the plurality of nozzles toward the medium; and a controller configured to:

determine a basic flushing amount for each nozzle;

make the liquid jetting head carry out flushing with the basic flushing amount for inner-side nozzles positioned at an inner side in the nozzle-row direction;

make the liquid jetting head carry out flushing with a flushing amount larger than the basic flushing amount, for outer-side nozzles positioned at an outer side in the nozzle-row direction, of the inner-side nozzles;

allocate the nozzles into the outer-side nozzles, based on an operation status of the liquid jetting apparatus at the time of carrying out flushing; and increase the number of nozzles allocated to the outer-side nozzles at the time of flushing such that smaller an amount of liquid jetted per unit time in a case that the liquid jetting head jets the liquid on to the medium, larger is the number of nozzles allocated to the outer-side nozzles at the time of flushing.

4. A liquid jetting apparatus configured to jet a liquid onto a medium, comprising:

a liquid jetting head including:

a plurality of nozzles arranged in rows in a nozzle-row direction; and a plurality of pressure generating elements configured to generate pressure for jetting the liquid from the plurality of nozzles toward the medium; and a controller configured to:

determine a basic flushing amount for each nozzle;

make the liquid jetting head carry out flushing with the basic flushing amount for inner-side nozzles positioned at an inner side in the nozzle-row direction; and make the liquid jetting head carry out flushing with a flushing amount larger than the basic flushing amount, for outer-side nozzles positioned at an outer side in the nozzle-row direction, of the inner-side nozzles;

wherein, in a case in which only a part of the nozzles are to be used when the liquid jetting head jets the liquid on to the medium, the controller is configured to allocate the part of the nozzles into the inner-side nozzles and the outer-side nozzles.

5. The liquid jetting apparatus according to claim 4, further comprising:

a transporting mechanism configured to transport the medium in a transporting direction which intersects the nozzle-row direction;

wherein a width of the medium in the nozzle-row direction is smaller range of arrangement in row of the plurality of nozzles in the nozzle-row direction; and wherein the controller is configured to allocate the inner-side nozzles and the outer-side nozzles among the part of the nozzles that jet the liquid toward the medium to.

6. The liquid jetting apparatus according to claim 5;

wherein the transporting mechanism is configured to transport the medium upon positioning at one side in the nozzle-row direction of the range of arrangement in row of the plurality of nozzles; and wherein the controller is configured to control an amount of increase with respect to the basic flushing amount, of the flushing amount of the nozzles positioned at the other end side in the nozzle-row direction, of the part of the nozzles, no be smaller than an amount of increase with respect to the basic flushing amount, of the flushing amount of the nozzles positioned at the one side in the nozzle-row direction.

7. The liquid jetting apparatus according to claim 5;

wherein the controller is configured to control the transporting mechanism to transport a first medium, and a second medium of which width in the nozzle-row direction is smaller than a width of the first medium; and wherein the controller is configured such that, for the nozzles other than the part of the nozzles for jetting the liquid toward the second medium among the nozzles for jetting the liquid toward the first medium, the flushing amount is let to be larger than the flushing amount for the part of the nozzles, before switching the type of the medium transported by the transporting mechanism from the second medium to the first medium.

8. The liquid jetting apparatus according to claim 4;

wherein the controller is configured such that, smaller the number of nozzles to be used in jetting the liquid onto the medium by the liquid jetting head, a ratio of the outer-side nozzles with respect to the number of nozzles to be used is higher.

9. A liquid jetting apparatus configured to jet a liquid onto a medium, comprising:

a liquid jetting head including:

a plurality of nozzles arranged in rows in a nozzle-row direction; and a plurality of pressure generating elements configured to generate pressure for jetting the liquid from the plurality of nozzles toward the medium;

a controller configured to:

determine a basic flushing amount for each nozzle;

make the liquid jetting head carry out flushing with the basic flushing amount for inner-side nozzles positioned at an inner side in the nozzle-row direction; and make the liquid jetting head carry out flushing with a flushing amount larger than the basic flushing amount, for outer-side nozzles positioned at an outer side in the nozzle-row direction, of the inner-side nozzles; and a transporting mechanism configured to transport the medium in a transporting direction which intersects the nozzle-row direction;

wherein a width in the nozzle-row direction of the medium is smaller than a range of arrangement in row of the plurality of nozzles in the nozzle-row direction; and wherein the controller is configured to control an amount of increase with respect to the basic flushing amount, of the flushing amount of the nozzles positioned at the other end side in the nozzle-row direction, of a part of the nozzles for jetting the liquid toward the medium, to be smaller than an amount of increase with respect to the basic flushing amount, of the flushing amount of the nozzles positioned at the one side in the nozzle-row direction.

10. A liquid jetting apparatus configured to jet a liquid onto a medium, comprising:

a liquid jetting head inducing:

a plurality of nozzles arranged in rows in a nozzle-row direction; and a plurality of pressure generating elements configured to generate pressure for jetting the liquid from the plurality of nozzles toward the medium; and a controller configured to:

determine a basic flushing amount for each nozzle;

make the liquid jetting head carry out flushing with the basic flushing amount for inner-side nozzles positioned at an inner side in the nozzle-row direction; and make the liquid jetting head carry out flushing with a flushing amount larger than the basic flushing amount, for outer-side nozzles positioned at an outer side in the nozzle-row direction, of the inner-side nozzles;

wherein the liquid jetting head includes a plurality of head units each of which includes a plurality of nozzles, and which are arranged in the nozzle-row direction;

wherein all nozzles of an inner-side head unit positioned at an inner side in the nozzle-row direction, among the plurality of head units, are the inner-side nozzles; and wherein all nozzles of an outer-side head unit positioned at an outer side in the nozzle-row direction of the inner-side head unit are the outer-side nozzles.

11. A liquid jetting apparatus configured to jet a liquid onto a medium, comprising:

a liquid jetting head including:

a plurality of nozzles arranged in rows in a nozzle-row direction; and a plurality of pressure generating elements configured to generate pressure for jetting the liquid from the plurality of nozzles toward the medium;

a controller configured to:

determine a basic flushing amount for each nozzle;

make the liquid jetting head carry out flushing with the basic flushing amount for inner-side nozzles positioned an inner side in the nozzle-row direction; and make the liquid jetting head carry out flushing with a flushing amount larger than the basic flushing amount, for outer-side nozzles positioned at an outer side in the nozzle-row direction, of the inner-side nozzles; and a casing configured to accommodate the liquid jetting head;

wherein a first wall portion of the casing is arranged on one side in the nozzle-row direction of the liquid jetting head, and a second wall portion of the casing is arranged on the other side in the nozzle-row direction of the liquid jetting head;

wherein a distance between the first wall portion and a first outer-side nozzle positioned at an end on one side of the nozzle-row direction, is longer than a distance between the second wall portion and a second outer-side nozzle positioned at an end on the other side of the nozzle-row direction; and wherein the controller is configured to control such that an amount of increase with respect to the basic flushing amount, of the flushing amount of the first outer-side nozzle is larger than an amount of increase with respect to the basic flushing amount, of the flushing amount of the second outer-side nozzle.

* * * * *